United States Patent [19]

Hashimoto et al.

[11] Patent Number: 4,503,428

[45] Date of Patent: Mar. 5, 1985

[54] RUNNING DISPLAY DEVICE IMPLEMENTED WITH A CPU

[75] Inventors: Shintaro Hashimoto, Ikoma; Yasuhiro Kotani; Yoshiyuki Fujikawa, both of Nara, all of Japan

[73] Assignee: Sharp Kabushiki Kaisha, Osaka, Japan

[21] Appl. No.: 139,124

[22] Filed: Apr. 10, 1980

[30] Foreign Application Priority Data

Apr. 10, 1979 [JP] Japan ..... 54-44051

[51] Int. Cl.[3] ..... G09G 3/00

[52] U.S. Cl. ..... 340/792; 340/711; 364/710

[58] Field of Search ..... 340/792, 726; 364/710

[56] References Cited

U.S. PATENT DOCUMENTS

| | | | |
|---|---|---|---|
| 3,493,956 | 2/1970 | Andrews et al. . | |
| 4,068,226 | 1/1978 | Bowman et al. . | |
| 4,099,247 | 7/1978 | Mikada et al. | 364/710 |
| 4,177,518 | 12/1979 | Olander et al. | 364/710 |
| 4,196,413 | 4/1980 | Sowa | 340/792 X |
| 4,205,312 | 5/1980 | Nelson | 340/792 |

*Primary Examiner*—David L. Trafton

*Attorney, Agent, or Firm*—Birch, Stewart, Kolasch & Birch

[57] ABSTRACT

An electronic device with a dot matrix display panel capable of displaying characters, symbols or other patterns is implemented with a central processing unit (CPU). When the length of the characters, symbols and other patterns is in excess of the capacity of the display panel, those intelligence signals are sequentially shifted on the display panel and preferably dot by dot.

7 Claims, 51 Drawing Figures

FIG. 15

| | BL=0 1 | 2 3 | 4 5 | 6 7 | 8 9 | A B | C D | E F |
|---|---|---|---|---|---|---|---|---|
| BM=D | 3 0 (A) | 3 A (B) | 2 B (C) | 3 C (D) | 3 1 (E) | 3 2 (F) | 3 3 (G) | 0 0 |
| BM=E | 0 0 | 0 0 | 0 0 | 0 0 | --- | --- | --- | --- |

word memory area when word counter = D,C

| | | 8 | 7 | 6 | 5 | 4 | 3 | 2 | 1 | BL=0 |
|---|---|---|---|---|---|---|---|---|---|---|
| character code buffer | (ZO) D1=3 | 0 | 0 | 3 | 3 | 2 | 3 | 3 | 3 | 3 |
| | (WO) BM=2 | 0 | 0 | 0 | A | B | C | 1 | 2 | 3 |

8bit character code

| | | | | | | | | | |
|---|---|---|---|---|---|---|---|---|---|
| display | | | A | 3 | C | D | E | F | G |

FIG. 18
| | | | |
|---|---|---|---|
| | | OFF | CL |
| STR | COMPI | CALL | SET |
| ♪ | % | √ | CE |
| CM | RM | M− | M+ |
| 7 | 8 | 9 | ÷ |
| 4 | 5 | 6 | × |
| 1 | 2 | 3 | − |
| 0 | · | = | + |
FIG. 19
| | | | |
|---|---|---|---|
| | | OFF | CL |
| Y | Z | SHIFT | SET |
| SPACE / U | V | W | DEL / X |
| Q | R | S | T |
| 7 / M | 8 / N | 9 / O | P |
| 4 / I | 5 / J | 6 / K | L |
| 1 / E | 2 / F | 3 / G | H |
| 0 / A | · / B | C | D |
FIG. 20
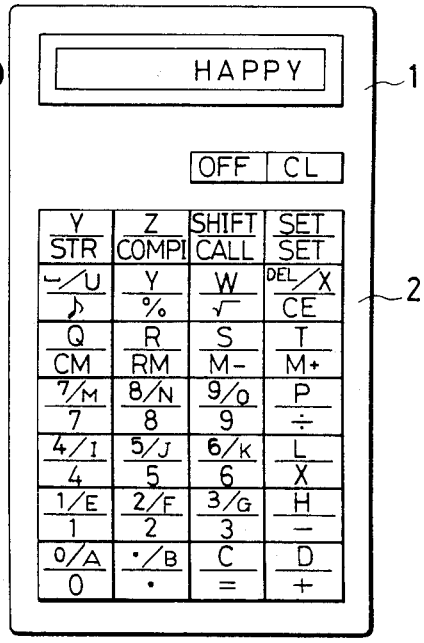
FIG. 24
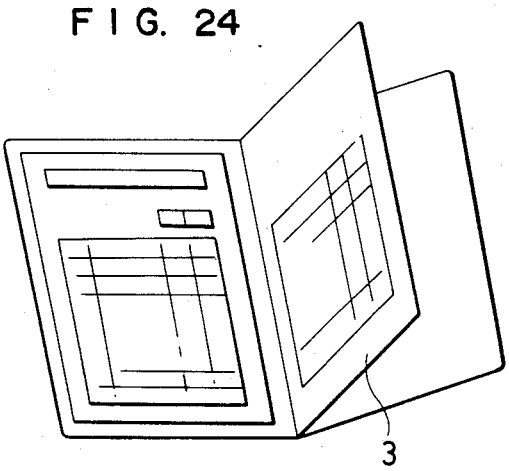

| | |
|---|---|
| t1 | HAPPY BIR |
| t2 | APPY BIRT |
| t3 | PPY BIRTH |
| t4 | PY BIRTHD |
| t5 | Y BIRTHDA |
| t6 | BIRTHDAY |
| t7 | BIRTHDAY |
| t8 | IRTHDAY |
| t9 | RTHDAY |
| t10 | THDAY ▸ H |
| t11 | HDAY ▸ HA |
| t12 | DAY ▸ HAP |

FIG. 21

| | | | |
|---|---|---|---|
| S1 | 1. | 1 | |
| S2 | 12. | 2 | |
| S3 | 12.× | × | |
| S4 | 12.÷ | ÷ | |
| S5 | ÷ 0. | · | |
| S6 | ÷ 0.33 | 3 | 3 |
| S7 | 36.36363 6 | = | |
| S8 | 36.36363 6 − | − | |
| S9 | − 40. | 4 | 0 |
| S10 | − 3.63636 4 + | + | |
| S11 | + 10 | 1 | 0 |
| S12 | 6.36363 6 | = | |

FIG. 22

| | |
|---|---|
| W M S | HAPPY BIR |

FIG. 23

FIG. 41

| | | BM=0000 | 0001 | 0010 | 0011 |
|---|---|---|---|---|---|
| DEC B | BL=0 | Y(0) | X(0) | W(0) | |
| | 1 | | | | Stroke 2 |
| | 2 | | | | 3 |
| | 3 | | | | 4 |
| | 4 | Y1 Y(4) | X1 X(4) | W1 W(4) | 5 Z1 Z(4) |
| | 5 | · | · | · | 6 · |
| | 6 | Y0 | X0 | W0 | 7 Z0 |
| | 7 | · | · | · | 8 · |
| | 8 | · | · | · | 9 · |
| | 9 | · | · | · | · |
| | A | Y7 | X7 | W7 | Z7 |
| | B | Y8 | X8 | W8 | Z8 |
| inc B | C | Yc | Xc | Wc | Zc |
| | D | y1 | x1 | w1 | z1 |
| | E | y2 | x2 | w2 | z2 |
| inc B | F | ys | xs | ws | zs |

| | | BM=0100 | 0101 | 0110 | 0111 |
|---|---|---|---|---|---|
| DEC B | BL=0 | | A B C D | running U | |
| | 1 | | E F G H | display M | |
| | 2 | | XD' | counter L | |
| | 3 | | XD | | |
| | 4 | V1 | word memory U | (word memory U | |
| | 5 | | addition counter L | addition counter)' L | |
| | 6 | V0 | KU | DP.8 DP.9 Er | |
| | 7 | | KL | ♪ S | |
| | 8 | | FU | DP.7 DP.6 DP.5 | |
| | 9 | | OVER | DP.4 DP.3 DP.2 DP.1 | |
| | A | V7 | Ba | | |
| | B | V8 | | | |
| inc B | C | Vs | Zs | | |
| | D | v1 | Ws | Wz register BL | |
| | E | v2 | Xs | | |
| inc B | F | vs | Ys | | |

FIG. 42 display chip RAM

| BL= | BM = | 1101 (D) | 1110 (E) | 1111 (F) |
|---|---|---|---|---|
| 0 | | 1 | 9 | 17 |
| 1 | | | | |
| 2 | | 2 | 10 | 18 |
| 3 | | | | |
| 4 | | 3 | 11 | 19 |
| 5 | | | | |
| 6 | | 4 | 12 | 20 |
| 7 | | | | |
| 8 | | 5 | 13 | 21 |
| 9 | | | | |
| A | | 6 | 14 | 22 |
| B | | | | |
| C | | 7 | 15 | 23 |
| D | | | | |
| E | | 8 | 16 | 24 |
| F | | | | |

CE = 1 word memory area 24(CHR.)

FIG.43
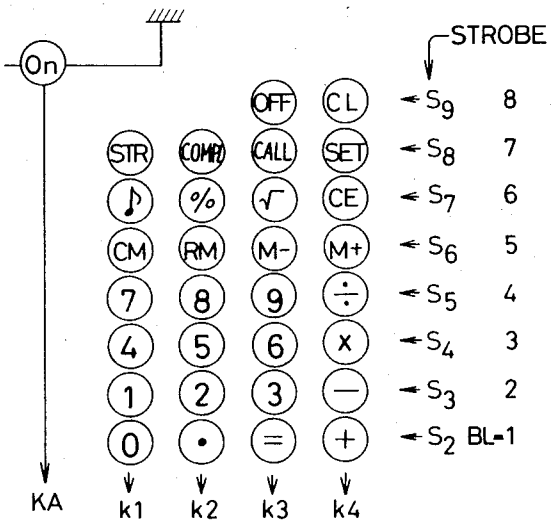
FIG.44
| KL \ KU | 0000 | 0001 |
|---|---|---|
| 0000 | | 0 |
| 0001 | CL | 1 |
| 0010 | OFF | 2 |
| 0011 | SET | 3 |
| 0100 | CALL | 4 |
| 0101 | CE | 5 |
| 0110 | CM | 6 |
| 0111 | RM | 7 |
| 1000 | M− | 8 |
| 1001 | M+ | 9 |
| 1010 | √ | • |
| 1011 | = | |
| 1100 | % | + |
| 1101 | STR | — |
| 1110 | COMP | × |
| 1111 | ♪ | ÷ |
FIG.45
| KL \ KU | 0000 | 0001 | 0010 | 0011 | 0100 | 0101 | 0110 | 0111 |
|---|---|---|---|---|---|---|---|---|
| 0000 | SPACE | 0 | SPACE | A | | | | |
| 0001 | | 1 | | E | | S | DP.5 | DP.1 |
| 0010 | | 2 | | F | DP.9 | ♪ | DP.6 | DP.2 |
| 0011 | | 3 | cursor down | G | | ♪S | | |
| 0100 | | 4 | cursor up | I | DP.8 | | DP.7 | DP.3 |
| 0101 | | 5 | × | J | ErDP.8 | | | |
| 0110 | | 6 | Q | K | | | | |
| 0111 | | 7 | R | M | | | | |
| 1000 | | 8 | S | N | | | | DP.4 |
| 1001 | | 9 | T | O | | | | |
| 1010 | | • | W | B | | | | |
| 1011 | | — minus | C | ◄ | | | | |
| 1100 | | + | V | D | | | | |
| 1101 | | — | Y | H | | | | |
| 1110 | | × | Z | L | | | | |
| 1111 | | ÷ | U | P | | | | |
FIG.46
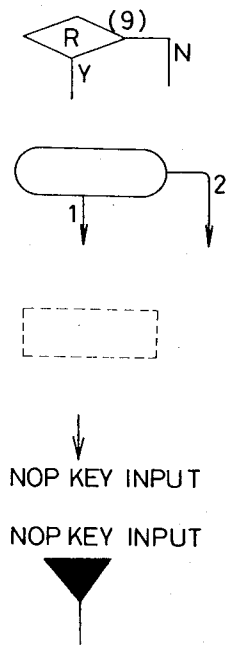

RUNNING DISPLAY DEVICE IMPLEMENTED WITH A CPU

BACKGROUND OF THE INVENTION

This invention generally relates to an electronic apparatus which stores a plurality of characters, symbols and similar display patterns and manifests a display function when desired as well as a data processing function.

In the past, it was possible for calculators to store telephone numbers and persons' names introduced via keys but impossible to display those characters on a display panel when those characters exceeded the capacity of the display panel.

OBJECTS AND SUMMARY OF THE INVENTION

It is therefore an object of the present invention to provide an improved electronic device which is able to store characters, symbols and similar display patterns without dividing them into several groups in light of a limited capacity of a display panel and display those display patterns while being continually shifted on the display panel. In other words, it becomes possible to introduce desired characters or symbols in numbers in excess of the capacity of a display panel via keys and thus store these characters or symbols in the form of a sentence when in a learn mode, as well as enabling a running display of the contents stored without punctuating these characters or symbols in accordance with the capacity of the display panel. In a preferred form of the present invention, these characters or symbols are shifted dot by dot on the display panel which is preferably of a dot matrix type.

On the other hand, the characters or symbols are displayed in a static (stationary) mode to avoid the operator's error in recognizing the significant positions of information on the display panel when the electronic device is used as a calculator.

Significant features of the present invention are enumerated as follows:

(1) A character storing electronic device which stores characters, symbols or other intelligence signals externally entered thereto and displays the same while being shifted on a display panel, even when those characters, symbols or other intelligence signals exceed the capacity of the display panel.

(2) An electronic device characterized in that both operands are displayed on a numerical display section of the display panel together with arithmetic symbols.

(3) An electronic device characterized in that a particular symbol is inserted between the end and beginning of characters, symbols or other intelligence signals contained within a character storage section to enable repeated display of those characters, symbols or other intelligence signals.

(4) In association with (1), it is decided whether all of the characters, symbols or other intelligence signals stored can be displayed at the same time, thus selecting either a static display mode or a running display mode.

(5) In association with (1), a display means and a calculation means are commonly used and a key input means and the display means are also commonly used.

(6) In association with (5), intermediate or final results of arithmetic operations are displayed in a static mode.

(7) An electronic device has a means for storing characters, symbols or other intelligence signals and a means for displaying the stored state of these characters, symbols or other intelligence signals.

(8) In association with (2), the arithmetic symbols are displayed on the right side of the first operand or on the left side of the second operand.

(9) An electronic device as set forth in (7) wherein whether the device is in a character write state is displayed together with the stored state of characters or symbols on the same display panel.

(10) An electronic device adapted for storing and displaying characters or symbols, in which an interrupted calculation is available during the course of a character display mode.

(11) An electronic device which stores characters, symbols or other intelligence signals externally entered thereto and displays the same, wherein both characters and numbers can be entered thereto at the same time.

(12) An electronic device which is capable of displaying characters or symbols stored therein automatically when a power is switched on.

BRIEF DESCRIPTION OF THE DRAWINGS

For a more complete understanding of the present invention and for further objects and advantages thereof, reference is now made to the following description taken in conjunction with the accompanying drawings, in which:

FIGS. 13 through 17 are diagrams showing a display mode in the above preferred form of the present invention;

FIGS. 18 and 19 show key arrangements to exchange according to a selected mode in the above preferred form of the present invention;

FIG. 20 is a front view of the appearance of the above preferred form of the present invention;

FIG. 21 shows a display state in which characters or symbols are sequentially shifted according to the above preferred form of the present invention;

FIG. 22 exemplifies key operations and a display mode when the above illustrated embodiment is used as a calculator;

FIG. 23 illustrates a display in the above illustrated embodiment;

FIG. 41 is a RAM map within the CPU in the illustrated embodiment of the present invention;

FIG. 42 is a diagram showing the relationship between a word memory and its contents in the illustrated embodiment of the present invention;

FIG. 43 is a diagram showing the relationship between key strobe signals and input terminals of the microprocessor in the illustrated embodiment of the present invention;

FIG. 44 shows key codes used in the above embodiment of the present invention;

FIG. 45 shows character codes used in the above embodiment of the present invention; and FIG. 46 is a description diagram as to the symbols used in flow charts of FIGS. 1 through 8.

DETAILED DESCRIPTION OF THE PREFERRED EMBODIMENTS

(OVERALL STRUCTURE OF ONE PREFERRED EMBODIMENT OF THE INVENTION)

Figure 9:
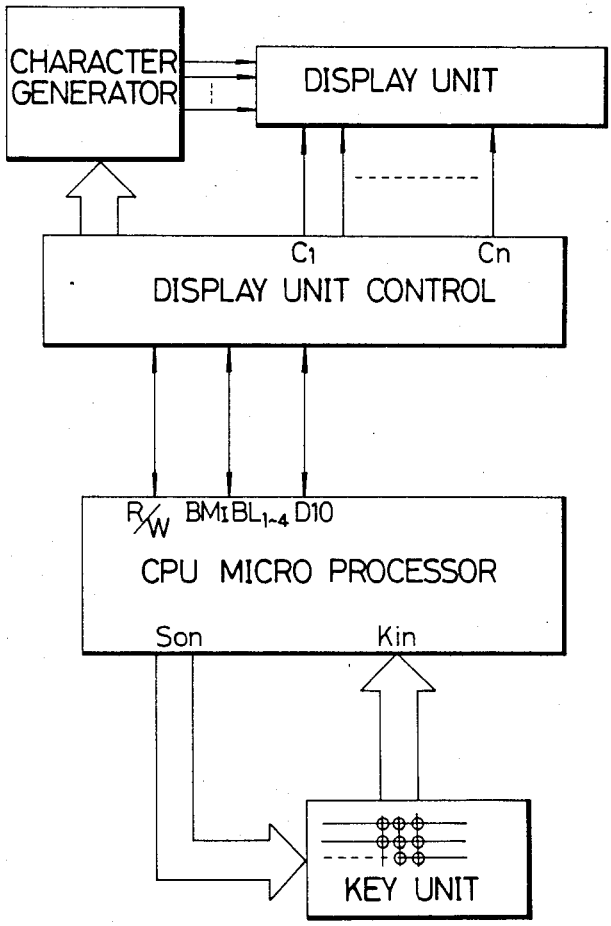
FIG. 9 is a schematic block diagram of an overall structure of the one preferred form of the present invention.

As viewed in FIG. 9, one preferred embodiment of the present invention comprises a key unit, a display unit, a display unit control for supplying and controlling display intelligence signals to the display unit, a buffer, a character generator for converting display codes from the display unit control into display pattern information and a central processing unit (CPU) which controls key inputs and supply of display information to the display unit control, executes various arithmetic and logic operations and processes the display information.

The display unit may comprise a well known display medium of a dot matrix type (for example, a 5×7 matrix) and is supplied the display information from the display unit control. The display unit control has a buffer memory for storing the display information to be supplied to the display unit in the form of character codes, the output of the buffer memory being applied to the character generator for conversion into display segment information and supply to the display unit. The outputs $C_1$–$C_n$ of the display unit control provide for the display unit control signals which help in converting the character codes within the display unit control into the segment information.

Accordingly, when it is desired to display any intelligence signals, information is always supplied to and displayed on the display unit by loading desired character codes or bit signals into display digit positions of the display unit or the buffer memory within the display unit control. The buffer memory within the display unit control may be implemented with a conventional RAM from which information can be read. The above mentioned CPU executes read and write operations on the display unit control. Signals BM and BL from the CPU are address signals which specify the address of the buffer memory within the display unit control, a signal DIO is a data bus signal and a R/W signal is a write signal to the buffer memory. The key unit is under control of outputs Son and inputs Kin from and to the CPU.

Figure 10:
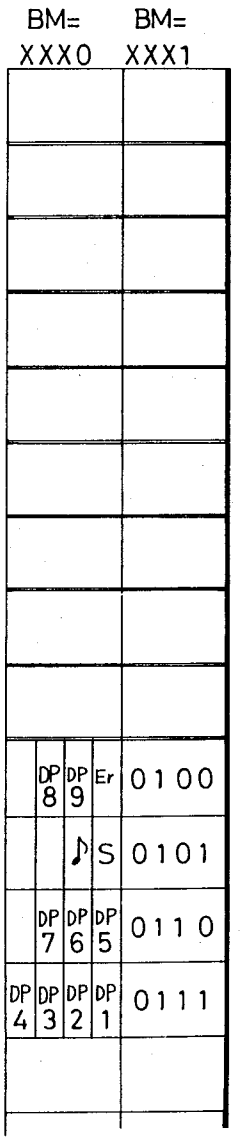
FIG. 10 is a diagram showing a format of a RAM within a display unit control in the above preferred form of the present invention.
Figure 11:
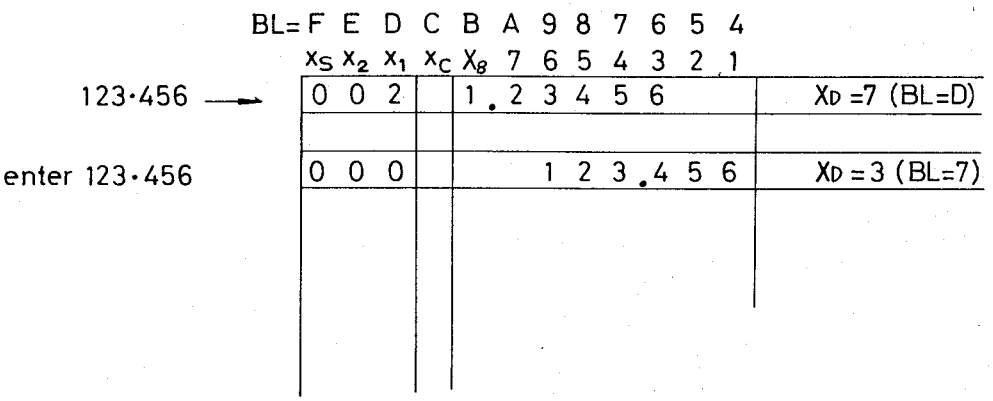
FIGS. 11 and 12 are diagrams showing a key input mode in the above preferred form of the present invention.

The buffer memory within the display unit control is illustrated in FIG. 10. Assuming that an address code is comprised of 4 bits, each character is defined by 8 bits BL=0, 1, etc. A second memory which exactly corresponds to the memory within the display unit control is implemented with a RAM area of the CPU chip. When the CPU prepares the display information to be displayed, it is stored within the RAM area of the CPU in the form of the character codes. When the CPU comes into a display mode, these codes are transferred into the buffer memory within the display unit control. As stated briefly above, the character codes thus transferred into the buffer memory are always converted into the segment information via the character generator and supplied to the display unit.

[CPU ARCHITECTHRE]

Figure 25:
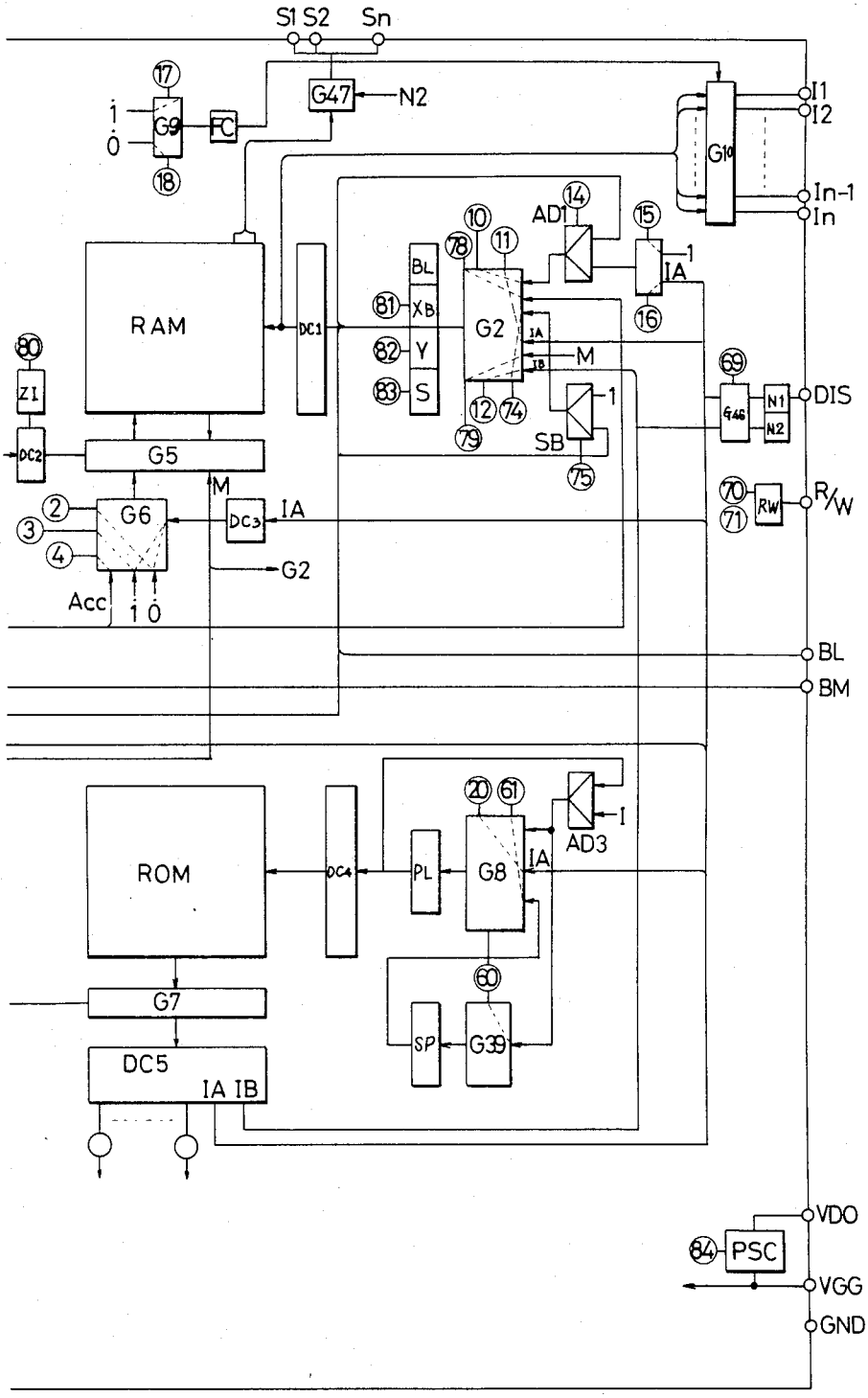
FIGS. 25-A and B are a wiring diagram of a specific example of a central processor unit (CPU) in the embodiment shown in FIG. 9.

FIGS. 25-A and 25-B show a logic wiring diagram of a specific example of the CPU scheme the details of which will be now described. The reference numbers (1), (2), etc. used herein indicate control instructions derived from a program store. In the following description flip flops are labeled F/F.

RAM (random access memory): this is of a 4 bit input and output capacity and accessible to a specific digit position thereof as identified by a digit address and a file address.

BL: a digit address counter associated with the memory RAM.

$DC_1$: a digit address decoder associated with the memory RAM.

BM: a file address counter associated with the memory RAM.

$DC_2$: a file address decoder for the memory RAM $AD_1$: this serves as an adder and a subtractor respectively in the absence and presence of a control instruction (14).

$AD_2$: an adder $G_1$: a gate for providing either a digit "1" or an operand $I_A$ to an input to the adder/subtractor $AD_1$ and delivering I or $I_A$ when a control instruction (15) or (16) is developed, respectively.

$G_2$: an input gate provided for the memory digit address counter BL, which enables the output of the adder/subtractor $AD_1$, the operand $I_A$ and another operand $I_B$ to pass therethrough respectively when control instructions (10), (11) and (12) are developed.

$G_3$: a gate to provide a digit "1" or the operand $I_A$ to an input to the adder/subtractor, the former being provided upon the development of an instruction (5) and the latter upon the development of an instruction (6).

$G_4$: an input gate to the memory file address BM which enables the output of the adder $AD_2$, the operand $I_A$ and the contents of an accumulator ACC to pass upon the development of instructions (7), (8) and (9).

$G_5$: a file selection gate for the memory RAM $DC_3$: a decoder which translates the operand $I_A$ and supplies a gate $G_6$ with a desired bit specifying signal.

$G_6$: an input gate to the memory RAM, which contains a circuit arrangement for introducing a binary code "1" into a specific bit position of the memory identified by the operand decoder $DC_3$ and a binary code "D" into a specific bit position identified by $DC_3$, respectively, when a control instruction (2) or (3) is developed. Upon the development of an instruction (4) the contents of the accumulator ACC are read out.

ROM: a read only memory

PL: a program counter PL which specifies a desired step in the read only memory ROM.

$DC_4$: a step access decoder for the read only memory $G_7$: an output gate which shuts off transmission of the output of the ROM to an instruction decoder $DC_5$ when a judge flip flop F/F J is set.

$DC_5$: an instruction decoder adapted to decode instruction codes derived from the ROM and divide them into an operation code area $I_O$ and operand areas $I_A$ and $I_B$, the operation code being decoded into any control instruction (1)-(61). The decoder $DC_5$ is further adapted to output the operand $I_A$ or $I_B$ as it is when sensing an operation code accompanied by an operand.

$AD_3$: an adder increments one the contents of the program counter PL.

$G_8$: an input gate associated with the program counter PL provides the operand $I_A$ and transmits the contents of a program stack register SP when the instructions (20) and (61) are developed, respectively. When the instructions (20), (61) and (60) are being processed, any output of the adder $AD_3$ is not transmitted. Otherwise the $AD_3$ output is transmitted to automatically load "1" into the contents of the program counter PL.

FC: a flag F/F $G_9$: an input gate for the flag F/F FC, which introduces binary codes "1" and "0" into the flag flip flop FC when the instructions (17) and (18) are developed, respectively.

$G_{10}$: a key signal generating gate provides the output of the memory digit address decoder $DC_1$ without any change when the flag F/F FC is in the reset state (0), and renders all outputs $I_l$-$I_n$ "1" whatever output $DC_1$ provides when FC is in the set state (1).

ACC: an accumulator of 4 bits long

X: a temporary register of 4 bits long $G_{11}$: an input gate for the temporary register X transmits the contents of the accumulator ACC and the stack register SX respectively upon the development of the instructions (29) and (59).

$AD_4$: an adder executes a binary addition on the contents of the accumulator ACC and other data. The output $C_4$ of the adder $AD_4$ assumes "1" when the fourth bit binary addition yields a carry.

C: a carry F/F $G_{12}$: an input gate for the carry F/F, which sets "1" into the carry F/F C in the presence of "1" of the fourth bit carry $C_4$ and "0" into the same in the absence of $C_4$(0) upon the development of (1). "1" and "0" are set into C upon the development of (21) and (22), respectively.

$G_{13}$: a carry (C) input gate enables the adder $AD_4$ to perform binary additions with a carry and thus transmits the output of the carry F/F C into the adder $AD_4$ in response to the instruction (25).

$G_{14}$: an input gate provided for the adder $AD_4$ and transfers the output of the memory RAM and the operand $I_A$ upon the development of (23) and (24), respectively.

F: an output buffer register having a 4-bit capacity.

$G_{15}$: an input gate which enables the contents of the accumulator ACC to enter into F upon the development of (31).

SD: an output decoder decodes the contents of the output buffer F into display segment signals $SS_1$-$SS_n$.

W: an output buffer register

SHC: a shift circuit for the output buffer register, which shifts the overall bit contents of the output buffer register W one bit to the right at a time in response to (32) or (33).

$G_{16}$: an input gate for the output buffer register W leads "1" and "0" into the first bit position of W upon (32) and (33), respectively. Immediately before "1" or "0" enters into the first bit position of W the output buffer shift circuit SHC becomes operative.

NP: an output control flag F/F.

$G_{17}$: an input gate to the output control flag F/F for receiving "1" and "0" upon the development of (34) and (35), respectively.

$G_{18}$: an output control gate provided for the buffer register W for providing the respective bit outputs thereof at one time only when the flag F/F NP is in the set state (1).

J: a judge F/F $IV_1$-$IV_4$: inverter circuits $G_{19}$: an input gate for the judge F/F J for transferring the state of an input $KN_1$ into J upon the development of (36). In the case where $KN_1=0$, $J=1$ because of intervention of the inverter $IV_1$.

$G_{20}$: an input gate for the judge F/F J adapted to transfer the state of an input $KN_2$ into J upon (37). When $KN_2=0$, $J=1$ because of intervention of the inverter $IV_2$.

$G_{21}$: an input gate for the judge F/F J adapted to transfer the state of an input $KF_1$ into J upon (38). When $KF_1=0$, $J=1$ because of the inverter $IV_3$.

$G_{22}$: an input gate for the judge F/F J adapted to transfer the state of the input $KF_2$ into J upon (39). When $KF_2=0$, $J=1$ because of the intervened inverter $IV_4$.

$G_{23}$: an input gate provided for the judge flip flop J for transmission of the state of an input AK into J upon the development of (40). When $AK=1$, $J=1$.

$G_{24}$: an input gate $G_{24}$ is provided for the judge flip flop J to transmit the state of an input TAB into J pursuant to (41). When $TAB=1$, $J=1$.

$G_{25}$: a gate provided for setting the judge F/F J upon the development of (42).

$V_1$: a comparator compares the contents of the memory digit address counter BL with preselected data and provides an output "1" if there is agreement. The comparator $V_1$ becomes operative when (43) or (44) is developed.

$G_{26}$: an input gate to the comparator $V_1$. The data $n_1$ to be compared are a specific higher address value which is often available in controlling the RAM. $n_1$ and $n_2$ are provided for comparison purposes upon the development of (43) and (44), respectively.

$G_{27}$: an input gate provided for the decision F/F J to enter "1" into J when the carry F/F C assumes "1" upon the development of (45).

$DC_6$: a decoder decodes the operand $I_A$ and helps decisions as to whether or not the contents of a desired bit position of the RAM are "1".

$G_{28}$: a gate transfers the contents of the RAM as specified by the operand decoder $DC_6$ into the judge F/F when (46) is derived. When the specified bit position of the RAM assumes "1", J=1.

$V_2$: a comparator decides whether or not the contents of the accumulator ACC are equal to the operand $I_A$ and provides an output "1" when the affirmative answer is provided. The comparator $V_2$ becomes operative according to (47).

$V_3$: a comparator decides under (48) whether the contents of the memory digit address counter BL are equal to the operand $I_A$ and provides an output "1" when the affirmative answer is obtained.

$V_4$: a comparator decides whether the contents of the accumulator ACC agree with the contents of the RAM and provides an output "1" in the presence of the agreement.

$G_{29}$: a gate which transfers the fourth bit carry $C_4$ occurring during additions into the judge F/F J. Upon the development of (50) $C_4$ is sent to F/F J. J=1 in the presence of $C_4$.

$F_A$: a flag F/F $G_{31}$: an input gate which provides outputs "1" and "0" upon the development of (52) and (53), respectively.

$G_{32}$: an input gate provided for setting the judge F/F J when the flag flip flop FA assumes "1".

$F_B$: a flag F/F $G_{33}$: an input gate for the flag F/F, which provides outputs "1" and "0" upon (55) and (56), respectively.

$G_{34}$: an input gate for the judge flip flop J is adapted to transfer the contents of the flag flip flop $F_B$ into the F/F J upon the development of (54). F=1 when $F_B=1$.

$G_{35}$: an input gate associated with the judge F/F J is provided for transmission of the contents of an input $\beta$ upon (19). When $\beta=1$, J=1.

$G_{36}$: an input gate associated with the accumulator ACC is provided for transferring the output of the adder $AD_4$ upon (26) and transferring the contents of the accumulator ACC after inverted via an inverter $IV_5$ upon (27). The contents of the memory RAM are transferred upon (28), the operand $I_A$ upon (13), the 4 bit input contents $k_1$-$k_4$ upon (57), and the contents of the stack register SA upon (59).

$IV_5$: an inverter circuit

SA: a stack register provides the output outside the present system.

SX: a stack register which also provides the output outside the system.

$G_{37}$: an input gate associated with the stack register SA transfers the accumulator ACC upon (58).

$G_{38}$: an input gate associated with the stack register SX transfers the contents of the temporary register X.

SP: a program stack register $G_{39}$: an input gate associated with the program stack register for loading the contents of the program counter PL incremented by "1" through the adder into the program stack register.

$F_D$: a flag F/F $F_E$: a flag F/F $G_{40}$: an input gate to the judge F/F J for shifting the contents of the flag F/F $F_D$ into F/F J in response to (64). Accordingly, J=1 when $F_D=1$.

$G_{41}$: an input gate to the flag F/F $F_D$, which provides "1" and "0" under control of (62) and (63), respectively.

$G_{42}$: an input gate to the judge F/F J for shifting the contents of the flag F/F $F_E$ into F/F J in response to (67). Accordingly, J=1 when $F_E=1$.

$G_{43}$: an input gate associated with the flag F/F $F_E$, which provides "1" and "0" under control of (65) and (66), respectively.

$G_{44}$: an input gate to the judge F/F J to transfer the contents of the input $\beta$ under control of (68). J=1 when $\alpha=1$.

$G_{45}$: a gate to transfer the contents of the accumulator ACC into a terminal $D_{I/O}$ upon receipt of (73).

$G_{46}$: a gate which gates the operands $I_A$ and $I_B$ onto display and key input controlling flags $N_1$ and $N_2$ under (69).

$G_{47}$: a gate which transfers a predetermined number of bits from the memory RAM and becomes operative under control of the state of the key input controlling flag $N_2$.

EO: an Exclusive-OR logic circuit which acts on the contents of the memory file address counter BM and the operand $I_A$.

SB: a circuit which takes "1" from the contents of the memory digit address counter BL in response to (75).

$X_B$: a temporary storage memory digit address counter which stores the output of $G_2$ in response to (81) and provides its output for $DC_1$.

Y: a temporary storage memory digit address counter which stores the output of $G_2$ in response to (82) and provides its output for $DC_1$.

S: a temporary storage memory digit address counter which stores the output of $G_2$ in response to (83) and provides its output for $DC_1$.

RW: a signal generator which develops a write/read signal for an external memory under (70) and (71).

PSC: a power supply control circuit which supplies a system power voltage $V_{DD}$ upon (84).

$Z_1$: a circuit which zeros the memory file address upon (80).

An illustrative example of the instruction codes contained within the ROM of the CPU structure, the name and function of the instruction codes and the control instructions developed pursuant to the instruction codes will now be tabulated in Table 1.

TABLE 1

| | Instruction Code | Instruction Name | Control Instruction |
|---|---|---|---|
| 1 | $I_O$ | SKIP | (42) |
| 2 | $I_O$ | AD | (23), (26) |
| 3 | $I_O$ | ADC | (23), (26), (25), (1) |
| 4 | $I_O$ | ADCSK | (23), (26), (25), (50), (1) |
| 5 | $I_O$ $I_A$ | ADI | (24), (26), (50) |
| 6 | $I_O$ $I_A$ | DC | (24), (26), (50) |
| 7 | $I_O$ | SC | (21) |

TABLE 1-continued

| | Instruction Code | Instruction Name | Control Instruction |
|---|---|---|---|
| 8 | $I_O$ | RC | 22 |
| 9 | $I_O$ $I_A$ | SM | 2 |
| 10 | $I_O$ $I_A$ | RM | 3 |
| 11 | $I_O$ | COMA | 27 |
| 12 | $I_O$ $I_A$ | LDI | 13 |
| 13 | $I_O$ $I_A$ | L | 28, 8 |
| 14 | $I_O$ $I_A$ | LI | 28, 8, 15, 10, 43 |
| 15 | $I_O$ $I_A$ | LD | 28, 8, 14, 15, 10, 44 |
| 16 | $I_O$ $I_A$ | X | 28, 4, 8 |
| 17 | $I_O$ $I_A$ | XI | 28, 4, 8, 15, 10, 43 |
| 18 | $I_O$ $I_A$ | XD | 28, 4, 8, 14, 16, 10, 44 |
| 19 | $I_O$ $I_A$ | LBLI | 11 |
| 20 | $I_O$ $I_A$ $I_B$ | LB | 8, 12 |
| 21 | $I_O$ $I_A$ | ABLI | 16, 10, 43 |
| 22 | $I_O$ $I_A$ | AMBI | 6, 7 |
| 23 | $I_O$ $I_A$ | T | 20 |
| 24 | $I_O$ | SKC | 45 |
| 25 | $I_O$ $I_A$ | SKM | 46 |
| 26 | $I_O$ $I_A$ | SKBI | 48 |
| 27 | $I_O$ $I_A$ | SKAI | 47 |
| 28 | $I_O$ | SKAM | 49 |
| 29 | $I_O$ | $SKN_1$ | 36 |
| 30 | $I_O$ | $SKN_2$ | 37 |
| 31 | $I_O$ | $SKF_1$ | 38 |
| 32 | $I_O$ | $SKF_2$ | 39 |
| 33 | $I_O$ | SKAK | 40 |
| 34 | $I_O$ | SKTAB | 41 |
| 35 | $I_O$ | SKFA | 51 |
| 36 | $I_O$ | SKFB | 54 |
| 37 | $I_O$ | SKFD | 64 |
| 38 | $I_O$ | SKFE | 67 |
| 39 | $I_O$ | WIS | 32 |
| 40 | $I_O$ | WIR | 33 |
| 41 | $I_O$ | NPS | 34 |
| 42 | $I_O$ | NPR | 35 |
| 43 | $I_O$ | ATF | 31 |

TABLE 1-continued

| | Instruction Code | Instruction Name | Control Instruction |
|---|---|---|---|
| 44 | $I_O$ | LXA | 29 |
| 45 | $I_O$ | XAX | 29, 30 |
| 46 | $I_O$ | SFA | 52 |
| 47 | $I_O$ | RFA | 53 |
| 48 | $I_O$ | SFB | 55 |
| 49 | $I_O$ | RFB | 56 |
| 50 | $I_O$ | SFC | 17 |
| 51 | $I_O$ | RFC | 18 |
| 52 | $I_O$ | SFD | 62 |
| 53 | $I_O$ | RFD | 63 |
| 54 | $I_O$ | SFE | 65 |
| 55 | $I_O$ | RFE | 66 |
| 56 | $I_O$ | SKA | 68 |
| 57 | $I_O$ | SKB | 19 |
| 58 | $I_O$ | KTA | 57 |
| 59 | $I_O$ | STPO | 58 |
| 60 | $I_O$ | EXPO | 58, 59 |
| 61 | $I_O$ $I_A$ | TML | 62, 20 |
| 62 | $I_O$ | RIT | 61 |
| 63 | $I_O$ $I_A$ $I_B$ | LNI | 69 |
| 64 | $I_O$ | READ | 70, 72 |
| 65 | $I_O$ | STOR | 71, 73 |
| 66 | $I_O$ $I_A$ | EX | 28, 4, 85, 16 |
| 67 | $I_O$ | DECB | 74, 75, 44 |
| 68 | $I_O$ | BMTA | 76 |
| 69 | $I_O$ | ATBM | 9 |
| 70 | $I_O$ | BTA | 77 |
| 71 | $I_O$ | ATB | 78 |
| 72 | $I_O$ | MTB | 79 |
| 73 | $I_O$ | SAG | 80 |
| 74 | $I_O$ | SAX | 81 |
| 75 | $I_O$ | SAY | 82, 80 |
| 76 | $I_O$ | SAP | 83 |
| 77 | $I_O$ $I_A$ | LDY | 28, 85, 10, 14, 43, 82 |
| 78 | $I_O$ | OFF | 84 |
| 79 | $I_O$ $I_A$ | LDA | 28, 85 |
| 80 | $I_O$ | ROT | 86, 87 |
| 81 | $I_O$ | INCB | 14, 10, 43 |

TABLE 1-continued

| | Instruction Code | | Instruction Name | Control Instruction |
|---|---|---|---|---|
| 82 | $I_O$ | $I_A$ | EXCI | (28), (4), (85), (14), (15), (10), (43) |
| 83 | $I_O$ | $I_A$ | EXCD | (28), (4), (85), (75), (74), (44) |

INSTRUCTION DESCRIPTION LISTED IN TABLE 1

SKIP:

Only the program counter PL is incremented without executing a next program step instruction, thus skipping a program step.

AD:

A binary addition is effected on the contents of the accumulator ACC and the contents of the RAM, the addition results being loaded back into the accumulator ACC.

ADC:

A binary addition is effected on the contents of the accumulator ACC, the memory RAM and the carry F/F C, the results being loaded back to the accumulator ACC.

ADCSK:

A binary addition is effected on the contents of the accumulator ACC, the memory RAM and the carry flip flop C, the results being loaded into the accumulator ACC. If the fourth bit carry $C_4$ occurs in the results, then a next program step is skipped.

ADI:

A binary addition is achieved upon the contents of the accumulator ACC and the operand $I_A$ and the results are loaded into the accumulator ACC. If the fourth bit carry $C_4$ is developed in the addition results, then a next program step is skipped.

DC:

The operand $I_A$ is fixed as "1010" (a decimal number "10") and a binary addition is effected on the contents of the accumulator ACC and the operand $I_A$ in the same way as in the ADI instruction. The decimal number 10 is added to the contents of the accumulator ACC, the results of the addition being loaded into ACC.

SC:

The carry F/F C is set ("1" enters into C).

RC:

The carry F/F C is reset ("0" enters into C).

SM:

The contents of the operand $I_A$ are decoded to give access to a desired bit position of the memory specified by the operand ("1" enters).

RM:

The contents of the operand $I_A$ are interpreted to reset a desired bit position of the memory specified by the operand ("0" enters).

COMA:

The respective bits of the accumulator ACC are inverted and the resulting complement to "15" is introduced into ACC.

LDI:

The operand $I_A$ enters into the accumulator ACC.

L:

The contents of the memory RAM are sent to the accumulator ACC and the operand $I_A$ to the file address counter BM.

LI:

The contents of the memory RAM are sent to the accumulator ACC and the operand $I_A$ to the memory file address counter BM. At this time the memory digit address counter BL is incremented. If the contents of BL agree with the preselected value $n_1$, then a next program step is skipped.

LD:

The contents of the memory RAM are exchanged with the contents of ACC and the operand $I_A$ is sent to the memory file address counter BM. The memory digit address counter BL is decremented. In the event that the contents of BL agree with the preselected value $n_2$, then a next program step is skipped.

X:

The contents of the memory RAM are exchanged with the contents of the accumulator ACC and the operand $I_A$ is loaded into the memory file address counter BM.

XI:

The contents of the memory RAM are exchanged with the contents of the accumulator ACC and the operand $I_A$ is sent to the memory file address counter BM. The memory digit address counter BL is incremented. In the event that BL is equal to the preselected value $n_1$, a next program step is skipped.

XD:

The contents of the memory RAM replaces the contents of the accumulator ACC, the operand $I_A$ being sent to the memory file address counter BM. The memory digit address counter BL at this time is incremented. If the contents of BL are equal to $n_2$, then a next program step is skipped.

LBLI:

The operand $I_A$ is loaded into the memory digit address counter BL.

LB:

The operand $I_A$ is loaded into the memory file address counter BM and the operand B to the memory digit address counter BL.

ABLI:

The operand $I_A$ is added to the contents of the memory digit address counter BL in a binary addition fashion, the results being loaded back to BL. If the contents of BL are equal to $n_1$, then no next program step is carried out.

ABMI:

The operand $I_A$ is added to the contents of the memory file address counter BM in a binary fashion, the results being into BM.

T:

The operand $I_A$ is loaded into the program step counter PL.

SKC:

If the carry flip flop C is "1", then no next program step is taken.

SKM:

The contents of the operand $I_A$ are decoded and a next program step is skipped as long as a specific bit position of the memory specified by the operand $I_A$ assumes "1".

SKBI:

The contents of the memory digit address counter BL are compared with the operand $I_A$ and a next succeeding program step is skipped when there is agreement.

SKAI:
The contents of the accumulator ACC are compared with the operand $I_A$ and if both are equal to each other a next program step is skipped.

SKAM:
The contents of the accumulator ACC are compared with the contents of the RAM and if both are equal a next program step is skipped.

$SKN_1$:
When the input $KN_1$ is "0", a next program step is skipped.

$SKN_2$:
When the input $KN_2$ is "0", a next program step is skipped.

$SKF_1$:
When the input $KF_1$ is "0", a next program step is skipped.

$SKF_2$:
When the input $KF_2$ is "0", a next program step is skipped.

SKAK:
When the input AK is "1", a next program step is skipped.

SKTAB:
When the input TAB is "1", a next program step is skipped.

SKFA:
When the flag F/F F/A assumes "1" a next program step is skipped.

SKFB:
When the flag F/F $F_B$ assumes "1", a next program step is skipped.

SKFD:
When the flag F/F $F_D$ assumes "1", a next program step is skipped.

SKFE:
When the flag F/F $F_E$ assumes "1", a next program step is skipped.

WIS:
The contents of the output buffer register W are one bit right shifted, the first bit position (the most significant bit position) receiving "1".

WIR:
The contents of the output buffer register W are one bit right shifted, the first bit position (the most significant bit position being loaded with "0").

NPS:
The output control F/F $N_p$ for the buffer register W is set ("1" enters).

NPR:
The buffer register output control flip flop $N_p$ is reset ("0" enters therein).

ATF:
The contents of the accumulator ACC are transferred into the output buffer register F.

LXA:
The contents of the accumulator ACC are unloaded into the temporary register X.

XAX:
The contents of the accumulator ACC are exchanged with the contents of the temporary register X.

SFA:
The flag F/F FA is set (an input of "1").

RFA:
The flag F/F FA is reset (an input of "0").

SFB:
The flag flip flop $F_B$ is set (an input of "1").

RFB:
The flag flip flop $F_B$ is reset (an input of "0").

SFC:
An input testing flag F/F $F_C$ is set (an input of "1").

RFC:
The input testing flag F/F $F_C$ is reset (an input of "0").

SFD:
The input testing flag F/F $F_D$ is set (an input of "1").

RFD:
The input testing flag F/F $F_D$ is reset (an input of "0").

SFE:
The input testing flag F/F $F_E$ is set (an input of "1").

RFE:
The input testing flag F/F $F_E$ is reset (an input of "0").

SKA:
When an input $\alpha$ is "1", a next program step is skipped.

SKB:
When an input $\beta$ is "1", a next program step is skipped.

KTA:
The inputs $k_1$–$k_4$ are introduced into the accumulator ACC.

STPO:
The contents of the accumulator ACC are sent to the stack register SA and the contents of the temporary register X to the stack register SX.

EXPO:
The contents of the accumulator ACC are exchanged with the stack register SA and the contents of the temporary register X with the stack register SX.

TML:
The contents of the program counter $P_L$ incremented by one are transferred into the program stack register SP and the operand $I_A$ into the program counter $P_L$.

RIT:
The contents of the program stack register SP are transmitted into the program counter $P_L$.

$LN_1$:
The operands $I_A$ and $I_B$ enter the display and key input controlling flag F/Fs $N_1$ and $N_2$, respectively.

READ:
Data externally applied to $D_{I/O}$ are introduced into the accumulator ACC.

STOR:
The contents of the accumulator ACC are unloaded into $D_{I/O}$.

EX:
The contents of the memory RAM are exchanged with that of the accumulator ACC and an exclusive-OR'ed output of the operand $I_A$ and the contents of the memory file address counter $B_M$ is supplied to $B_M$.

DECB:
The memory digit address counter $B_L$ is decremented by "1". When the contents of $B_L$ are equal to the preset value $n_2$, a next instruction is skipped.

BMTA:
The memory file address counter $B_M$ is unloaded into the accumulator ACC.

ATMB:

The accumulator ACC is unloaded into the file address counter $B_M$.

BTA:

A selected one of the memory digit address counters $B_L$, $X_B$, Y and S is unloaded into the accumulator ACC.

ATB:

The accumulator ACC is unloaded into a selected one of the memory digit address counters $B_L$, $X_B$, Y and S.

MTB:

The memory RAM is unloaded into a selected one of the memory digit address counters $B_L$, $X_B$, Y and S.

SAG:

The memory file address which specifies a next step is reduced to "0000".

SAX:

The memory file address which specifies a next step is determined by the contents of $X_B$.

SAY:

The memory file address which specifies a next step is determined by the contents of Y, while the file address is reset to "0000".

SAP:

The memory file address which specifies a next step is determined by the contents of S.

LDY:

The memory RAM is unloaded into the accumulator ACC and an exclusive-OR'ed output of the memory file address counter $B_M$ and the operand $I_A$ is introduced into $B_M$. A selected one of $B_L$, X, Y and S is incremented by one. However, when the selected counter is equal to the preset value $n_1$, a next program step is skipped. The memory digit address which specifies a next step is determined by the contents of Y.

OFF:

The system power voltage $V_{DD}$ is switched OFF. Power supply continues in connection with a power supply control section to the RAM containing the built-in output buffer.

LDA:

The contents of the memory are unloaded into the accumulator and an exclusive-OR'ed output of the operand $I_A$ and the contents of the memory file address counter $B_M$ is returned back to $B_M$.

ROT:

The contents of the accumulator is right shifted in cooperation with C F/F.

INCB:

The memory digit address counter $B_L$ is incremented. When the contents of $B_L$ agree with the preset value $n_1$, a next instruction is skipped.

EXCI:

Exchange takes place between the accumulator and the memory and an exclusive-OR'ed output of the memory address counter $B_M$ and the operand $I_A$ is loaded back into $B_M$ and the digit address counter $B_1$ is incremented. When $B_L=n_1$ a next step is skipped.

EXCD:

Exchange takes place between the accumulator and the memory and an exclusive-OR'ed output of the memory file address counter $B_M$ and the operand $I_A$ is loaded into $B_M$ and the digit address counter $B_L$ is decremented. When $B_L=n_2$, a next instruction is skipped.

Major processing operations of the CPU structure will now be described in sufficient detail.

(1) PROCEDURE OF LOADING A SAME VALUE N INTO A SPECIFIC REGION OF THE MEMORY (NNN→X)

TABLE 2

(Type 1)

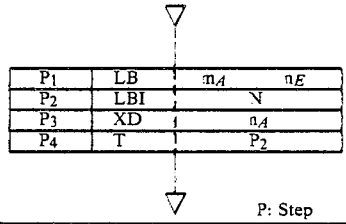

Figure 26:
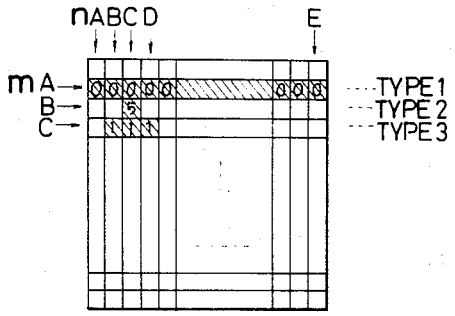
FIGS. 26 through 35 are explanation diagrams of basic information processing steps according to the present invention.

In Table 2, $P_1$—The first digit position of the memory to be processed is specified by a file address $m_A$ and a digit address $n_E$. (see FIG. 26)

$P_2$—The value N is loaded into ACC.

$P_3$—The value N is loaded into the specified region of the memory by exchange between the memory and ACC. With no change in the file address of the memory, $m_A$ is specified and the digit address is decremented to determine a digit to be next introduced. By determining $n_2$ as the final digit value $n_A$ to be introduced, the next step $P_4$ is skipped to complete the processing of the Type 1 since $BL=n_2$ under the condition that the value N has been completely loaded into the specific region.

$P_4$—LDI and XD are carried out repeatedly from the program address $P_2$ up to BL=V.

TABLE 3

(Type 2)

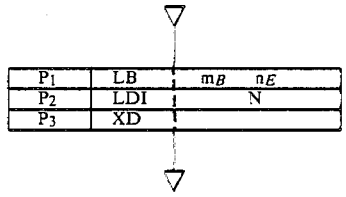

In Table 3, $P_1$—The digit of the memory to be processed is determined by the file address $m_B$ and the digit address $n_C$.

$P_2$—The ACC is loaded with the value N.

$P_3$—By exchange between the memory and ACC the value N is loaded into the above specified region of the memory. This completes the processing of Type 2. An operand area of $X_D$ is necessary to the next succeeding process and not to this step.

TABLE 4

(Type 3)

TABLE 4-continued

| | | | |
|---|---|---|---|
| $P_1$ | LB | $m_C$ | $n_C$ |
| $P_2$ | LDI | N | |
| $P_3$ | XD | $m_C$ | |
| $P_4$ | SKBI | $n_A$ | |
| $P_5$ | T | $P_2$ | |

In Table 4, $P_1$—The first digit of the memory to be processed is specified by the file address $m_C$ and the digit address $n_O$.

$P_2$—The ACC is loaded with the value N.

$P_3$—By exchange between the memory and ACC the value N is loaded into that specified region of the memory. With no change in the file address of the memory $m_C$ is specified and the digit address is decremented in order to determine the digit to be next loaded therein.

$P_4$—It is decided whether the digit processed during the step $P_3$ is the final digit $n_B$. If it is $n_B$, then the digit address is decremented to $n_A$. An operand area of the SKI instruction is occupied by $n_A$, thus loading the final digit with the value N. In reaching $P_4$, conditions are fulfilled and the next step $P_5$ is skipped, thereby terminating the type 3. If the conditions are not fulfilled, $P_5$ is then reached.

$P_5$—The program address $P_2$ is specified and $P_2$–$P_4$ are repeated until $BL=n_A$.

(2) PROCEDURE OF LOADING A PREDETERMINED NUMBER OF DIFFERENT VALUES INTO A SPECIFIC REGION OF THE MEMORY ($N_1$, $N_2$, $N_3$, . . . →X)

(Type 1) For example, four digit values $N_4N_3N_2N_1$ are loaded an arbitrary digit position in the same manner as above.

TABLE 5

| | | | |
|---|---|---|---|
| $P_1$ | LB | $m_A$ | $n_E$ |
| $P_2$ | LDI | $N_1$ | |
| $P_3$ | XI | $m_A$ | |
| $P_4$ | LDI | $N_2$ | |
| $P_5$ | XI | $m_A$ | |
| $P_6$ | LDI | $N_3$ | |
| $P_7$ | XI | $m_A$ | |
| $P_8$ | LDI | $N_4$ | |
| $P_9$ | XI | $m_A$ | |

Figure 27:
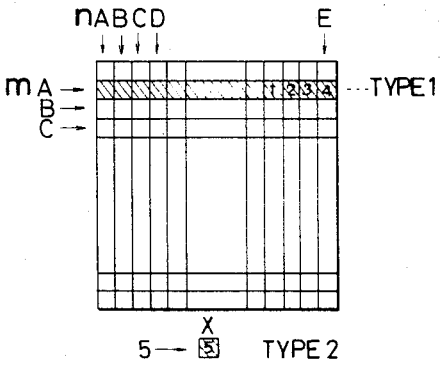

$P_1$—The first processed digit position of the memory is specified by the file address $m_A$ and the digit address $n_E$. (see FIG. 27)

$P_2$—A constant $N_1$ is loaded into ACC.

$P_3$—Through exchange between the memory and the ACC the value $N_1$ is loaded into the above specified region of the memory. The file address of the memory remains unchanged as $m_A$, whereas the digit address is up for introduction of the next digit.

$P_4$—A second constant $N_2$ is loaded into ACC.

$P_5$—Since the second digit of the memory has been specified during $P_3$, the second constant $N_2$ is loaded into the second digit position of the memory through exchange between the memory and ACC.

$P_6$–$P_9$—The same as in the above paragraph.

(Type 2) Any value of 0–15 is loaded into a predetermined register.

TABLE 6

| | | |
|---|---|---|
| $P_1$ | LDI | N |
| $P_2$ | LXA | |

In Table 6, $P_1$—The value N is loaded into ACC.

$P_2$—The value N is transmitted from ACC into the register X.

(3) PROCEDURE OF TRANSFERRING THE CONTENTS OF A SPECIFIC REGION OF THE MEMORY TO A DIFFERENT REGION OF THE MEMORY

TABLE 7

(Type 1) X ⟶ Y

| | | | |
|---|---|---|---|
| $P_1$ | LB | $m_A$ | $n_E$ |
| $P_2$ | L | $m_B$ | |
| $P_3$ | XI | $m_A$ | |
| | T | $P_2$ | |

Figure 28:
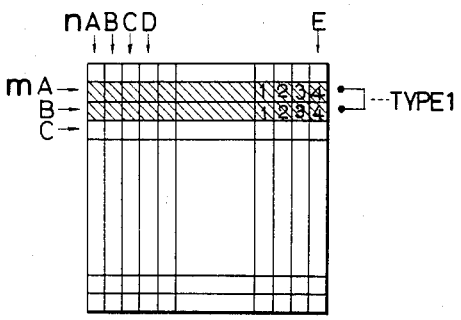

In Table 7, $P_1$—The first memory file address is specified as $m_A$ and the first digit address as $n_E$. (see FIG. 28)

$P_2$—The contents of the first digit position of the memory are loaded into ACC and its designation, the second memory file address is specified as $m_B$ prior to the transmission step $P_3$.

$P_3$—The first digit memory contents loaded into the ACC are replaced by the same second memory digit contents so that the first memory contents are transmitted into the second memory. In order to repeat the above process, the first memory file address $m_A$ is again set. The value of the final digit $n_A$ to be transmitted is previously selected to be $n_1$. Since $BL \rightarrow n_1$ after the overall first memory contents have been sent to the second memory, the next step $P_4$ is skipped to complete the processing of Type 1. The digit address is progressively incremented until BL=V (the final digit). Through the step $P_4$ the file address is set up at $m_A$ to lead back to $P_2$, thereby specifying the first memory.

$P_4$—The program address is set at the step $P_2$ and the instructions $P_2$ and $P_3$ are repeatedly executed until $BL=n_1$. The transmission step is advanced digit by digit.

Figure 29:
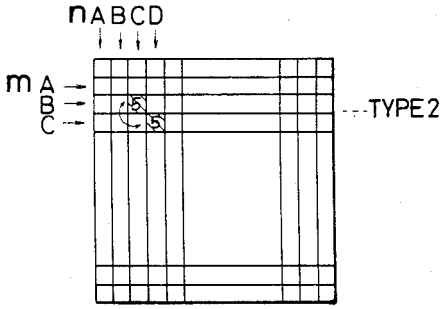

In Table 8, it is noted that $P_1$ specifies the region of the memory which is subject to the processing step, using the file address $m_A$ and the digit address $n_C$. (see FIG. 29)

TABLE 8

(Type 2) $X_n \longrightarrow Y_m$

| | | | |
|---|---|---|---|
| $P_1$ | LB | $m_B$ | $n_C$ |
| $P_2$ | L | $m_C$ | |
| $P_3$ | LBLI | $n_O$ | |
| $P_4$ | X | | |

$P_1$—The region of the memory to be processed is determined by the file address $m_A$ and the digit address $n_C$.

$P_2$—The contents of the memory as specified above are unloaded into ACC and the memory file address is set at $m_C$ prior to the next transmission step $P_4$.

$P_3$—The digit address of the memory, the destination for the transmission process, is specified as $m_C$. The destinated region of the memory is specified via the steps $P_2$ and $P_3$.

$P_4$—The contents of ACC are exchanged with the contents of the regions of the memory specified by $P_2$ and $P_3$. The operand of X has no connection with the present process.

TABLE 9

(Type 3)

| | | | |
|---|---|---|---|
| $P_1$ | LB | $m_B$ | $n_C$ |
| $P_2$ | L | | |
| $P_3$ | LXA | | |

Figure 30:
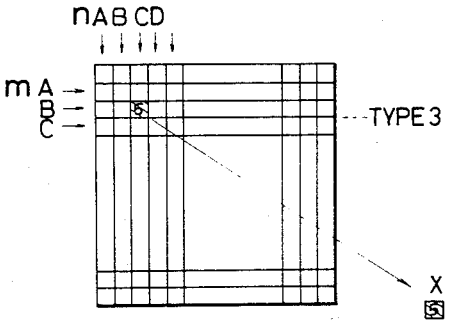

In Table 9, $P_1$—The region of the memory to be processed is identified by the file address $m_A$ and the digit address $n_C$. (see FIG. 30)

$P_2$—The contents of the memory region specified during $P_1$ are unloaded into ACC.

$P_3$—The contents of the memory transmitted from ACC are sent to the register X, completing the type 3 processing.

(4) PROCEDURE OF EXCHANGING CONTENTS BETWEEN A SPECIFIC REGION OF THE MEMORY AND A DIFFERENT REGION (X→Y)

TABLE 10

(Type 1) $X \rightleftarrows Y$

TABLE 10-continued

| | | | |
|---|---|---|---|
| $P_1$ | LB | $m_A$ | $n_E$ |
| $P_2$ | L | $m_B$ | |
| $P_3$ | X | $m_A$ | |
| $P_4$ | XI | $m_A$ | |
| $P_5$ | T | $P_2$ | |

Figure 31:
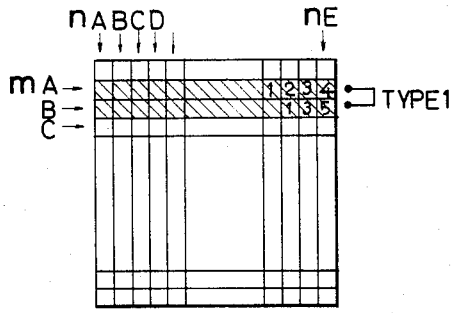

In Table 10, $P_1$—The first memory file address to be processed is specified as $m_A$ and the first digit address as $n_E$. (See FIG. 31)

$P_2$—The specific digit contents of the first memory are loaded into ACC and the second memory file address is specified as $m_B$ for preparation of the next step.

$P_3$—The specific digit contents of the first memory contained within ACC are exchanged with the same digit contents of the second memory specified by $P_2$. The file address of the first memory is specified as $m_A$ in order to load the contents of the memory now in ACC into the first memory.

$P_4$—The contents of the second memory now in ACC are exchanged with the contents of the first memory at the corresponding digit positions so that the contents of the second memory are transferred to the first memory. Exchanges are carried out during the steps $P_2$–$P_4$.

The first memory is specified on by the file address $m_A$, while the digit address is incremented to select a next address.

Exchange is carried out progressively digit by digit. The final digit value $n_A$ is previously set at $n_1$ such that $B_L = n_1$ after the exchange operation between the first memory and the second has been effected throughout the all digit positions, thus skipping the next step $P_5$ and completing the processing of Type 1.

$P_5$—The program address $P_2$ is selected and the instructions for $P_2$ to $P_4$ are executed repeatedly until $B_L = n_1$. The exchange operation is advanced digit by digit.

TABLE 11

(Type 2) $X_n \rightleftarrows Y_m$

| | | | |
|---|---|---|---|
| $P_1$ | LB | $m_B$ | $n_C$ |
| $P_2$ | L | $m_C$ | |
| $P_3$ | LBLI | $n_O$ | |
| $P_4$ | X | $m_B$ | |
| $P_5$ | LBLI | $n_C$ | |
| $P_6$ | X | | |

Figure 32:
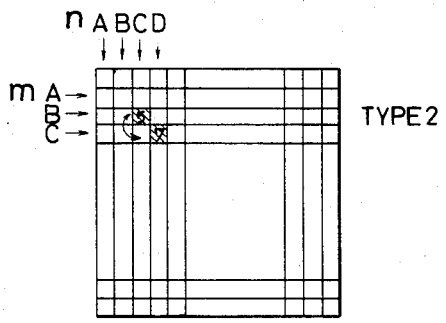
Figure 33:
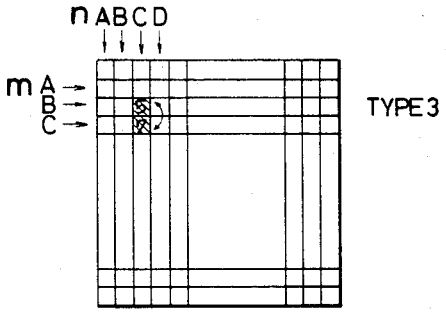

In Table 11, $P_1$—The file address of the first memory to be processed is specified as $m_A$ and the digit address as $n_C$. (see FIG. 32)

$P_2$—The contents of the specific digit position of the first memory are unloaded into ACC and the file address of the second memory is specified as $m_C$ and ready to exchange.

$P_3$—The digit address of the second memory, the destination for the exchange process, is specified as $n_O$ to determine the destinated memory address.

$P_4$—The contents of the first memory now within ACC are exchanged with that of the second memory. At the same time the file address $m_B$ of the first memory is again specified to transfer the contents of the first memory to the first memory.

$P_5$—The digit address $n_C$ of the first memory is specified to determine the destination address of the first memory.

$P_6$—The contents of the second memory now within ACC are exchanged with the contents of the first memory.

TABLE 12

(Type 3) $X_n \rightleftarrows Y_n$

| | | | |
|---|---|---|---|
| $P_1$ | LB | $m_B$ | $n_C$ |
| $P_2$ | L | $m_C$ | |
| $P_3$ | X | $m_B$ | |
| $P_4$ | X | | |

In Table 12, $P_1$—The file address $m_A$ of the first memory to be processed is specified and the digit address $n_C$ is specified.

$P_2$—The contents of the first memory are loaded into ACC and the file address $m_C$ of the second memory is selected.

$P_3$—The exchange is carried out between the first and second memory so that the contents of the first memory are loaded into the second memory. Prior to the step $P_4$ the file address $m_B$ of the first memory is selected again.

$P_4$—The exchange is effected between the contents of the second memory and the first memory.

TABLE 13

(Type 4)

| | | | |
|---|---|---|---|
| $P_1$ | LB | $m_B$ | $n_C$ |
| $P_2$ | L | $m_B$ | |
| $P_3$ | XAX | | |
| $P_4$ | X | | |

Figure 34:
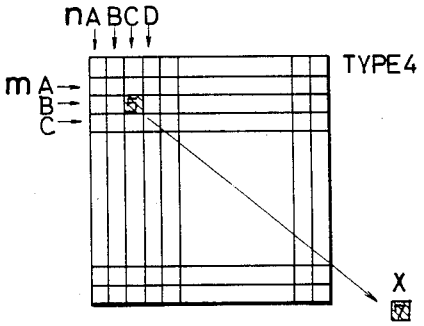

In Table 13, $P_1$—The region of the memory to be processed is specified by the file address $m_A$ and the digit address $n_C$. (see FIG. 34)

$P_2$—The contents of the memory region specified in $P_1$ above are loaded into ACC. The file address $m_B$ is kept being selected prior to the exchange with the contents of the register X.

$P_3$—The exchange is effected between ACC and the register X so that the contents of the memory are shifted to the register X.

$P_4$—Through the exchange between ACC containing the contents of the register X and the memory, the contents of the register X are substantially transferred into the memory, thus accomplishing the Type 4 processing.

(5) PROCEDURE OF EFFECTING A BINARY ADDITION OR SUBTRACTION OF A GIVEN VALUE N ONTO A SPECIFIC REGION OF THE MEMORY

TABLE 14

(Type 1) $M_1 + N \longrightarrow M$

| | | | |
|---|---|---|---|
| $P_1$ | LB | $m_B$ | $n_C$ |
| $P_2$ | L | $m_B$ | |
| $P_3$ | ADI | N | |
| $P_4$ | X | | |

Figure 35:
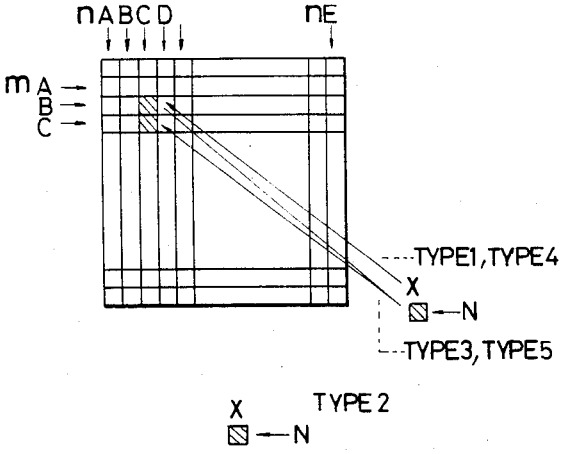

In Table 14, $P_1$—The region of the memory to be processed is specified by the file address $m_B$ and the digit address $n_C$. (see FIG. 35)

$P_2$—The contents of the memory specified by the step $P_1$ are unloaded into ACC.

The memory file address is set again at $m_B$ to specify the same memory.

$P_3$—The operand specifies the value N to be added and the contents of the memory contained within ACC are added with the value N, the results being loaded back to ACC.

$P_4$—The sum contained with ACC is exchanged with the contents of the memory specified by the step $P_2$, thus completing the Type 1 processing.

TABLE 15

(Type 2) $X + N \longrightarrow X$

| | | |
|---|---|---|
| $P_1$ | XAX | |
| $P_2$ | ADI | N |
| $P_3$ | XAX | |

In Table 15, $P_1$—The exchange is effected between the register X and ACC.

$P_2$—The operand specifies the value N to be added and an addition is carried out on the contents of the register X now within ACC and the value N, with the results back to ACC.

$P_3$—Through the exchange between the resulting sum within ACC and the contents of the register X, the processing of Type 2 ($X+N \rightarrow X$) is performed.

TABLE 16

(Type 3) $M_1 + N \longrightarrow M_2$

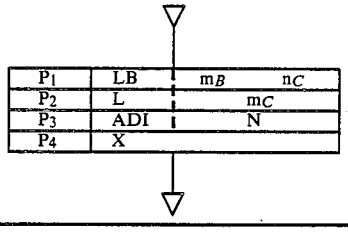

In Table 16, $P_1$—The region of the first memory to be processed is decided by the file address $m_B$ and the digit address $n_C$.

$P_2$—The contents of the memory specified by $P_1$ are loaded into ACC. The file address $m_C$ of the second memory is specified to return addition results to the second memory.

$P_3$—The operand specifies the value N to be added and the value N is added to the contents of the memory now within ACC, with the results being loaded into ACC.

$P_4$—The resulting sum within ACC is exchanged with the contents of the second memory as specified by $P_2$, thus completing the processing of Type 3.

TABLE 17

(Type 4) $M_1 - N \longrightarrow M_1$

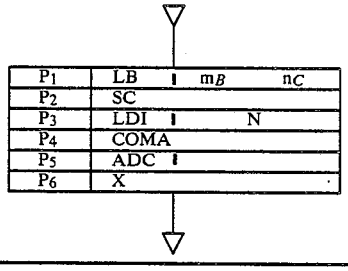

In Table 17, $P_1$—There are specified the file address $m_B$ and the digit address $n_C$ of the memory to be processed.

$P_2$—Subtraction is carried out in such a way that the complement of a subtrahend is added to a minuend and the F/F C remains set because of the absence of a borrow from a lower digit position.

$P_3$—ACC is loaded with the subtrahend N.

$P_4$—The complement of the subtrahend to "15" is evaluated and loaded into ACC.

$P_5$—In the event that any borrow occurs during the subtraction, the complement of the subtrahend to "16" is added to the minuend. If a borrow free state is denoted as C=1, then a straight binary subtraction of $\overline{ACC}+C+M \rightarrow ACC$ is effected.

$P_6$—The resulting difference during $P_5$ is returned to the same memory through the exchange between ACC and that memory.

TABLE 18

(Type 5) $M_1 - N \longrightarrow M_2$

TABLE 18-continued

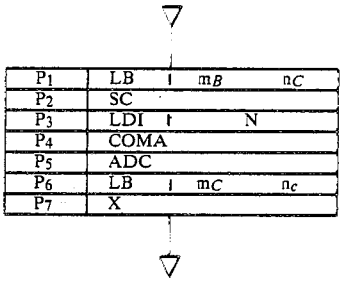

In Table 18, $P_1$–$P_5$—Same as Type 4

$P_6$—To load the resulting difference during $P_5$ into the second memory, the file address $m_C$ and the digit address $n_C$ of the second memory are selected.

$P_7$—Through exchange the resulting difference is transferred from ACC into the second memory as specified by the step $P_6$.

TABLE 19

(Type 6) $X - N \longrightarrow X$

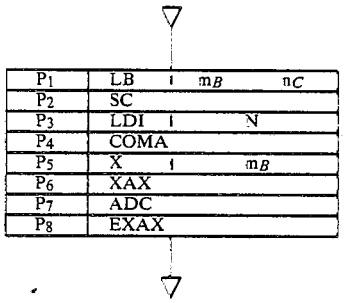

In Table 19, $P_1$—The file address $m_B$ and the digit address $n_C$ of the memory ready for the step $P_5$ are selected.

$P_2$—Subtraction is carried out in the manner of adding the complement of a subtrahend to a minuend and the F/F C remains set because of the absence of a borrow from a lower digit position.

$P_3$—ACC is loaded with the subtrahend N.

$P_4$—The complement of the subtrahend to "15" is evaluated and loaded into ACC.

$P_5$—To accomplish calculations with the contents of the register X, the memory as specified by $P_1$ is loaded with the contents of ACC.

$P_6$—The contents of the register X are transmitted into ACC through the exchange process. After this step the memory contains the complement of the subtrahend to "15" and ACC contains the contents of X.

$P_7$—ACC+M+C corresponds to X−N and the results of a binary subtraction are loaded into ACC.

$P_8$—The contents of ACC are exchanged with the contents of X and the value of X−N is transmitted into X, thereby completing the processing of Type 6.

TABLE 20

(Type 7) $N - M_1 \longrightarrow M_1$

TABLE 20-continued

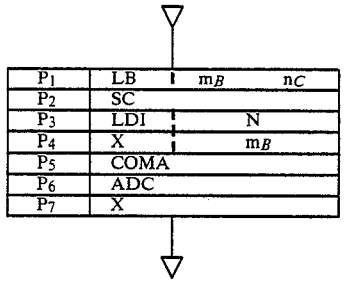

In Table 20, $P_1$—The file address $m_B$ and the digit address $n_C$ of the memory to be processed are selected.

$P_2$—One-digit subtraction is effected in the manner of adding the complement of a subtrahend to a minuend, in which case F/F C remains set.

$P_3$—ACC is loaded with a minuend.

$P_4$—The exchange is effected between the memory (the subtrahend) and ACC and the memory file address remains as $m_B$ for preparation of $P_7$.

$P_5$—The complement of a subtrahend in ACC to "15" is evaluated and loaded into ACC.

$P_6$—In the event that there is no borrow from a lower digit position, the complement of a subtrahend to "16" is added to a minuend. If a borrowless state is denoted as C=1, then N−M is substantially executed by $\overline{ACC}+C+M$, the resulting difference being loaded into ACC.

$P_7$—Since the memory file address remains unchanged during $P_4$, the difference is unloaded from ACC back to the memory, thus completing the processing of Type 7.

TABLE 21

(Type 8) $N - M_1 \longrightarrow M_2$

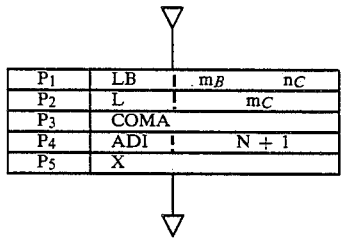

In Table 21, $P_1$—The file address $m_B$ and the digit address $n_C$ of the memory to be processed are selected.

$P_2$—The contents specified by the step $P_1$ and corresponding to a subtrahend are loaded into ACC. The file address $m_C$ of the second memory is specified for preparation of a step $P_5$.

$P_3$—The complement of the subtrahend to "15" is evaluated and loaded into ACC.

$P_4$—The operand is made a minuend plug "1". This subtraction is one digit long and accomplished by adding the complement of the subtrahend to the minuend. A conventional complementary addition is defined as $\overline{ACC}+C+M$ as in the Type 7 processing in the absence of a borrow as defined by C=1. Since the ADI instruction carries C, $\overline{ACC}+1$ is processed in advance. This completes the processing of Type 8 of N−M, the results being stored within ACC.

$P_5$—The difference obtained from the step $P_4$ is transmitted into the second memory specified by $P_2$.

TABLE 22

(Type 9) $M \pm 1 \longrightarrow M$

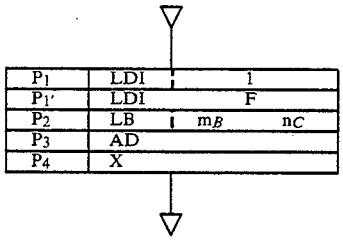

$P_1$—(When M+1) ACC is loaded with a binary number "0001" (=1).

$P_1'$—(When M−1) ACC is loaded with a binary number "1111" (=15).

$P_2$—The file address $m_B$ and the digit address $n_C$ of the memory to be processed are selected.

$P_3$—The contents of the memory specified by $P_2$ are added to the contents contained within ACC during $P_1$ or $P_1'$, the sum thereof being loaded into ACC. In the case of $P_1$ ACC+1 and in the case of $P_1'$ ACC−1.

$P_4$—The results are unloaded from ACC to the original memory position, thus completing the processing fashion of Type 9.

(6) PROCEDURE OF EFFECTING A DECIMAL ADDITION OR SUBTRACTION BETWEEN A SPECIFIC REGION OF THE MEMORY AND A DIFFERENT REGION

TABLE 23

(Type 1) $X + W \longrightarrow X$

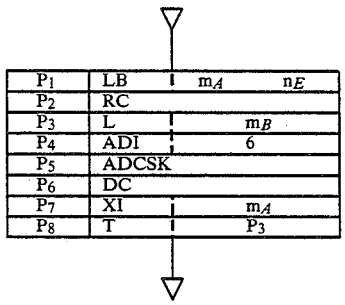

In Table 23, $P_1$—The first digit position of the first memory to be processed is identified by the file address $m_A$ and the digit address $n_E$.

$P_2$—The carry F/F C is reset because of a carry from a lower digit position in effecting a first digit addition.

$P_3$—The contents of the specific digit position of the first memory are loaded into ACC and the file address $m_B$ of the second memory is selected in advance of additions with the contents of the second memory during $P_4$.

$P_4$—"6" is added to the contents of the specific digit position of the first memory now loaded into ACC for the next succeeding step $P_5$ wherein a decimal carry is sensed during addition.

$P_5$—ACC already receives the contents of the first memory compensated with "6" and a straight binary addition is effected upon the contents of ACC and the contents of the second memory at the corresponding digit positions, the results being loaded back to ACC. In the event a carry is developed during the binary addition at the fourth bit position, $P_7$ is reached without passing $P_6$. The presence of the carry during the fourth bit addition implies the development of a decimal carry.

$P_6$—In the event the decimal carry failed to develop during the addition $P_5$, "6" for the process $P_4$ is overruded. An addition of "10" is same as a subtraction of "6".

$P_7$—The one-digit decimal sum is unloaded from ACC into the second memory and the digit address is incremented for a next digit addition and the file address $m_A$ of the first memory is selected. The final digit to be added is previously set at $n_1$. Since $BL=n_1$ after the overall digit addition is effected upon the first and second memory, the next succeeding step $P_8$ is skipped to thereby complete the processing of Type 1.

$P_8$—The program address $P_3$ is selected and the instructions $P_3$–$P_7$ are repeatedly executed until $BL=n_1$. A decimal addition is effected digit by digit.

TABLE 24

(Type 2) X − W ⟶ X

| | | | |
|---|---|---|---|
| $P_1$ | LB | $m_A$ | $n_E$ |
| $P_2$ | SC | | |
| $P_3$ | L | $m_B$ | |
| $P_4$ | COMA | | |
| $P_5$ | ADCSK | | |
| $P_6$ | DC | | |
| $P_7$ | XI | $m_A$ | |
| $P_8$ | T | $P_3$ | |

In Table 24, $P_1$—The first digit position of the first memory to be processed is specified by the file address $m_A$ and the digit address $n_E$.

$P_2$—Subtraction is performed in the manner of adding the complement of a subtrahend to a minuend and F/F C is set because of the absence of a borrow from a lower digit position during the first digit subtraction.

$P_3$—The contents of the specific digits in the first memory, the subtrahend, are loaded into ACC and the file address $m_B$ of the second memory is specified in advance of the step $P_7$ with the second memory.

$P_4$—The complement of the subtrahend to "15" is evaluated and loaded into ACC.

$P_5$—In the event that there is no borrow from a lower digit place, the complement of the subtrahend is added to the minuend to perform a subtraction. On the contrary, in the presence of a borrow, the complement of the subtrahend is added to the minuend. If a borrowless state is denoted as $C=1$, then a binary addition of $\overline{ACC}+C+M \rightarrow ACC$ is effected. The development of a carry, as a consequence of the execution of the ADSCK instruction, implies failure to give rise to a borrow and leads to the step $P_7$ without the intervention of the step $P_6$. Under these circumstances the addition is executed with the second memory, thus executing substantially subtraction between the first and second memories.

$P_6$—In the case where no carry is developed during the execution of the ADCSK instruction by the step $P_5$, the calculation results are of the sexadecimal notation and thus coverted into a decimal code by subtraction of "6" (equal to addition of "10").

$P_7$—The resulting difference between the first and second memories is transmitted from ACC into the second memory. The digit address is incremented and the file address $m_A$ of the first memory is specified in advance of a next succeeding digit subtraction. The final digit to be subtracted is previously determined as $n_1$. Since $BL=n_1$ after the overall-digit subtraction has been completed, the next step $P_8$ is skipped to thereby conclude the processing of Type 2.

$P_8$—After selection of the program address $P_3$ the instructions $P_3$–$P_7$ are repeatedly executed until $BL=n_1$. The decimal subtraction is advanced digit by digit.

(7) PROCEDURE OF SHIFTING ONE DIGIT THE CONTENTS OF A SPECIFIC REGION OF THE MEMORY

TABLE 25

(Type 1) Right Shift

| | | | |
|---|---|---|---|
| $P_1$ | LB | $m_A$ | $n_A$ |
| $P_2$ | LDI | 0 | |
| $P_3$ | XD | $m_A$ | |
| $P_4$ | T | $P_3$ | |

In Table 25, $P_1$—The file address $m_A$ and the digit address $n_A$ of the memory to be processed are determined.

$P_2$—ACC is loaded with "0" and ready to introduce "0" into the most significant digit position when the right shift operation is effected.

$P_3$—The exchange is carried out between XCC and the memory and the digit address is decremented to specific a one digit lower position. The memory address is still at $m_A$. XD is repeated executed through $P_4$ and $P_3$. By the step ACC⟷M "0" is transmitted from ACC to the most significant digit position of the memory which in turn provides its original contents for ACC. When the digit address is down via B and XD is about to be executed at $P_3$ via $P_4$, the second most significant digit is selected to contain the original content of the most significant digit position which has previously been contained within ACC. At this time ACC is allowed to contain the contents of the second most significant digit position. The least significant digit is previously selected as $n_2$. If the transmission step reaches the least significant digit position $BL=n_2$ is satisfied and $P_4$ is skipped. In other words, the digit contents are shifted down to thereby conclude the processing of Type 1.

$P_4$—XD is repeated at $P_3$ until $BL=V$.

TABLE 26

(Type 2) Left Shift

| | | | |
|---|---|---|---|
| $P_1$ | LB | $m_A$ | $n_E$ |
| $P_2$ | LDI | 0 | |
| $P_3$ | XI | $m_A$ | |
| $P_4$ | T | $P_3$ | |

In Table 26, $P_1$—The file address $m_A$ and the least significant digit $n_E$ of the memory to be processed are determined.

$P_2$—ACC is loaded with "0" and ready to introduce "0" into the least significant digit position when the left shift operation is started.

$P_3$—The exchange is carried out between ACC and the memory and the digit address is incremented to specify a one digit upper position. The memory address is still at $m_A$. XD is repeated executed through $P_4$ and $P_3$. By the step ACC→M, "0" is transmitted from ACC to the least significant digit position of the memory which in turn provides its original contents for ACC. When the digit address is up via $P_3$ and XD is about to be executed at $P_3$ via $P_4$, the second least significant digit is selected to contain the original content of the least significant digit position which has previously been contained within ACC. At this time ACC is allowed to contain the contents of the second least significant digit position. The most significant digit is previously selected as $n_1$.

If the transmission step reaches the most significant digit position, $BL=n_1$ is satisfied and $P_4$ is skipped. In other words, the digit contents are shifted up to thereby conclude the processing of Type 2.

$P_4$—XI is repeated at $P_3$ until BL=V.

(8) PROCEDURE OF SETTING OR RESETTING A ONE-BIT CONDITION F/F ASSOCIATED WITH A SPECIFIC REGION OF THE MEMORY

TABLE 27

(Type 1)

| | | | |
|---|---|---|---|
| $P_1$ | LB | $m_A$ | $n_C$ |
| $P_2$ | SM | N | |

In Table 27, $P_1$—The file address $m_B$ and the digit address $n_C$ of a region of the memory to be processed are determined.

$P_2$—"1" is loaded into a desired bit N within the digit position of the memory specified by $P_1$, thus concluding the processing of Type 1.

TABLE 28

(Type 2)

TABLE 28-continued

| | | | |
|---|---|---|---|
| $P_1$ | LB | $m_B$ | $n_C$ |
| $P_2$ | RM | N | |

In Table 28, $P_1$—The file address $m_B$ and the digit address $n_C$ of a region of the memory to be processed are determined.

$P_2$—"0" is loaded into a desired bit N within the digit position of the memory specified by $P_1$, thus concluding the processing of Type 2.

(9) PROCEDURE OF SENSING THE STATE OF THE ONE-BIT CONDITIONAL F/F ASSOCIATED WITH A SPECIFIC REGION OF THE MEMORY AND CHANGING A NEXT PROGRAM ADDRESS (STEP) AS A RESULT OF THE SENSING OPERATION

TABLE 29

| | | | |
|---|---|---|---|
| $P_1$ | LB | $m_B$ | $n_C$ |
| $P_2$ | SKM | N | |
| $P_3$ | T | $P_n$ | |
| $P_4$ | $OP_1$ | | |
| | | | |
| $P_n$ | $OP_2$ | | |

In Table 29, $P_1$—There are specified the file address $m_B$ and the digit address $n_C$ where a desired one-bit conditional F/F is present.

$P_2$—In the case where the contents of the bit position (corresponding to the conditional F/F) specified by N within the memory region as selected during $P_1$ assume "1", the step proceeds to $P_4$ with skipping $P_3$, thus executing the operation $OP_1$. In the event that the desired bit position bears "0", the next step $P_3$ is skipped.

$P_3$—When the foregoing $P_2$ has been concluded as the conditional F/F in the "0" state, the program step $P_n$ is selected in order to execute the operation $OP_2$.

(10) PROCEDURE OF DECIDING WHETHER THE DIGIT CONTENTS OF A SPECIFIC REGION OF THE MEMORY REACH A PRESELECTED NUMERAL AND ALTERING A NEXT PROGRAM ADDRESS (STEP) ACCORDING TO THE RESULTS OF THE DECISION

TABLE 30

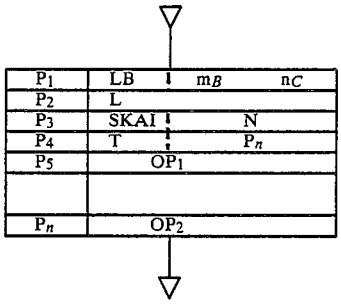

In Table 30, $P_1$—The region of the memory which contains contents to be decided is identified by the file address $m_B$ and the digit address $n_C$.

$P_2$—The contents of the memory as identified during $P_1$ are unloaded into ACC.

$P_3$—The contents of ACC are compared with the preselected value N and if there is agreement the step advances toward $P_5$ without executing $P_4$ to perform the operation $OP_1$. $P_4$ is however reached if the contents of ACC are not equal to N.

$P_4$—The program address (step) $P_n$ is then selected to perform the operation $OP_2$.

(11) PROCEDURE OF DECIDING WHETHER THE PLURAL DIGIT CONTENTS OF A SPECIFIC REGION OF THE MEMORY ARE EQUAL TO A PRESELECTED NUMERAL AND ALTERING A PROGRAM STEP ACCORDING TO THE RESULTS OF THE DECISION

TABLE 31

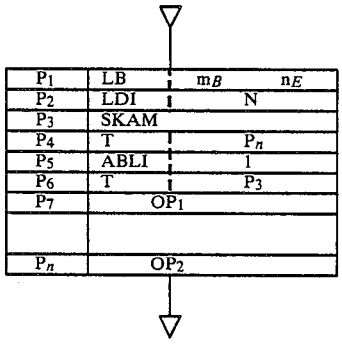

In Table 31, $P_1$—The region of the memory to be judged is identified by the file address $m_B$ and the first digit address $n_E$.

$P_2$—The value N is loaded into ACC for comparison.

$P_3$—The value V within ACC is compared with the digit contents of the specific region of the memory and if there is agreement $P_5$ is reached without passing $P_4$ to advance the comparison operation toward the next succeeding digit. $P_4$ is selected in a non-agreement.

$P_4$—In the case of a non-agreement during $P_3$ the program address (step) $P_n$ is specified to execute the operation forthwith.

$P_5$—The digit address is incremented by adding "1" thereto. This step is aimed at evaluating in sequence a plurality of digits within the memory. The ultimate digit to be evaluated is previously determined as (V). The comparison is repeated throughout the desired digit positions. If a non-agreement state occurs on the way, the operation $OP_2$ is accomplished through $P_4$. In the case where the agreement state goes on till BL=V, there is selected $P_7$ rather than $P_6$ to perform the operation $OP_1$.

$P_6$—When the agreement state goes on during $P_5$, $P_3$ is reverted for evaluation.

(12) PROCEDURE OF DECIDING WHETHER THE CONTENTS OF A SPECIFIC REGION OF THE MEMORY ARE SMALLER THAN A GIVEN VALUE AND DECIDING WHICH ADDRESS (STEP) IS TO BE EXECUTED

TABLE 32

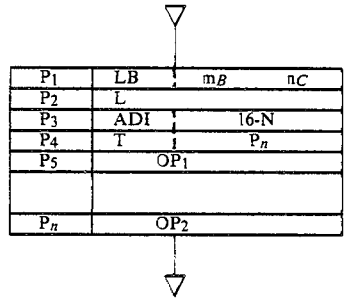

In Table 32, $P_1$—The file address $m_B$ and the digit address $n_C$ of the memory are decided.

$P_2$—The contents of the memory as specified during $P_1$ are unloaded into ACC.

$P_3$—N is the value to be compared with the contents of the memory and the operand area specifies 16−N which in turn is added to the contents of ACC, the sum thereof being loaded back to ACC. The occurrence of a fourth bit carry during the addition suggests that the result of the binary addition exceeds 16, that is, $M+(16-N)\geqq 16$ and hence $M\geqq N$. The step is progressed toward $P_4$.

$P_4$—When $M\geqq N$ is denied, the program step $P_n$ is selected to carry out the operation $OP_2$.

(13) PROCEDURE OF DECIDING WHETHER THE CONTENTS OF A SPECIFIC REGION OF THE MEMORY ARE GREATER THAN A GIVEN VALUE AND DECIDING WHICH ADDRESS (STEP) IS TO BE EXECUTED

TABLE 33

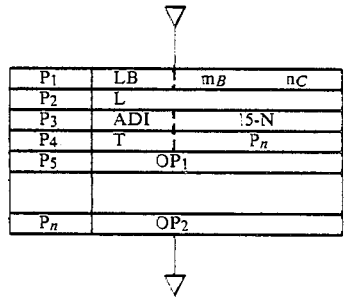

In Table 33, $P_1$—The file address $m_B$ and the digit address $n_C$ of the memory are decided.

$P_2$—The contents of the memory as specified during $P_1$ are unloaded into ACC.

$P_3$—N is the value to be compared with the contents of the memory and the operand area specifies 15−N which in turn is added to the contents of ACC, the sum thereof being loaded back to ACC. The occurrence of a fourth bit carry during the addition suggests that the result of binary addition exceeds 16, that is, $M+(15-N)\geqq 16$ and hence $M\geqq N+1$ and $M>N$. The step is progressed toward $P_5$ with skipping $P_4$, thus performing the operation $OP_1$. In the absence of a carry (namely, $M>N$) the step $P_4$ is reached.

$P_4$—When $M\geqq N$ is denied, the program address (Step) $P_n$ is selected to carry out the operation $OP_2$.

(14) PROCEDURE OF DISPLAYING THE CONTENTS OF A SPECIFIC REGION OF THE MEMORY

TABLE 34

(Type 1)

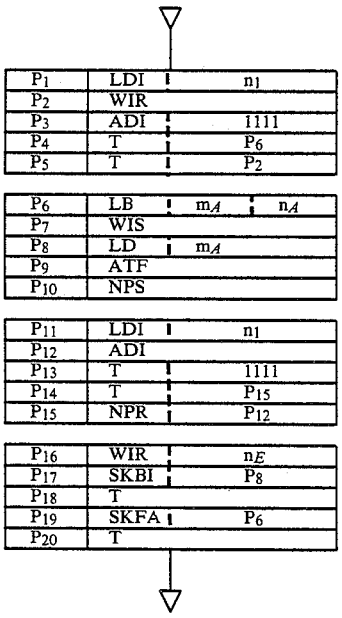

$P_1$—The bit number $n_1$ of the buffer register W is loaded into ACC to reset the overall contents of the buffer register W for generating digit selection signals effective to drive a display panel on a time sharing basis.

$P_2$—After the overall contents of the register W are one bit shifted to the right, its first bit is loaded with "0". This procedure is repeated via $P_4$ until $C_4=1$ during $P_3$, thus resetting the overall contents of W.

$P_3$—The operand $I_A$ is decided as "1111" and AC+1111 is effected (this substantially corresponds to ACC−1). Since ACC is loaded with $n_1$ during $P_1$, this process is repeated $n_1$ times. When the addition of "1111" is effected following ACC=0, the fourth bit carry $C_4$ assumes "0". When this occurs, the step is advanced to $P_4$. Otherwise the step is skipped up to $P_5$.

$P_4$—When the fourth bit carry $C_4=0$ during ACC+1111, the overall contents of W are reduced to "0" to thereby complete all the pre-display processes. The first address $P_6$ is set for the memory display steps.

$P_5$—In the event that the fourth bit carry $C_4=1$ during ACC+1111, the overall contents or W have not yet reduced to "0". Under these circumstances $P_2$ is reverted to repeat the introduction of "0" into W.

$P_6$—The first digit position of the memory region which contains data to be displayed is identified by the file address $m_A$ and the digit address $n_A$.

$P_7$—After the contents of the register W for generating the digit selection signals are one bit shifted to the right, its first bit position is loaded with "1" and thus ready to supply the digit selection signal to the first digit position of the display.

$P_8$—The contents of the specific region of the memory are unloaded into ACC. The file address of the memory still remains at $m_A$, whereas the digit address is decremented for the next succeeding digit processing.

$P_9$—The contents of the memory is shifted from ACC to the buffer register F. The contents of the register F are supplied to the segment decoder SD to generate segment display signals.

$P_{10}$—To lead out the contents of the register W as display signals, the conditional F/F $N_P$ is supplied with "1" and placed into the set state. As a result of this, the contents of the memory processed during $P_9$ are displayed on the first digit position of the display.

$P_{11}$—A count initial value $n_2$ is loaded into ACC to determine a one digit long display period of time.

$P_{12}$—ACC−1 is carried out like $P_3$. When ACC does not assume "0" (when $C_4=1$) the step is skipped up to $P_{14}$.

$P_{13}$—A desired period of display is determined by counting the contents of ACC during $P_{12}$. After the completion of the counting $P_{15}$ is reached from $P_{13}$. The counting period is equal in length to a one-digit display period of time.

$P_{14}$—Before the passage of the desired period of display the step is progressed from $P_{12}$ to $P_{14}$ with skipping $P_{13}$ and jumped back to $P_{12}$. This procedure is repeated.

$P_{15}$—$N_P$ is reset to stop supplying the digit selection signals to the display. Until $N_p$ is set again during $P_{10}$, overlapping display problems are avoided by using the adjacent digit signals.

$P_{16}$—The register W is one bit shifted to the right and its first bit position is loaded with "0". "1" introduced during $P_7$ is one bit shifted down for preparation of the next succeeding digit selection.

$P_{17}$—It is decided whether the ultimate digit of the memory to be displayed has been processed and actually whether the value $n_E$ of the last second digit has been reached because the step $P_8$ of $B_L-1$ is in effect.

$P_{18}$—In the event that ultimate digit has not yet been reached, $P_8$ is reverted for the next succeeding digit display processing.

$P_{19}$—For example, provided that the completion of the display operation is conditional by the flag F/F FA, FA=1 allows $P_{20}$ to be skipped, thereby concluding all the displaying steps.

$P_{20}$—If FA=1 at $P_{19}$, the display steps are reopened from the first display and the step is jumped up to $P_6$.

TABLE 35

(Type 2)

TABLE 35-continued

| | | | |
|---|---|---|---|
| $P_1$ | LDI | $n_1$ | |
| $P_2$ | WIR | | |
| $P_3$ | ADI | 1111 | |
| $P_4$ | T | $P_6$ | |
| $P_5$ | T | $P_2$ | |
| $P_6$ | LB | $m_A$ | $n_A$ |
| $P_7$ | LD | $m_A$ | |
| $P_8$ | LXA | | |
| $P_9$ | LD | $m_A$ | |
| $P_{10}$ | STPO | | |
| $P_{11}$ | WIS | | |
| $P_{12}$ | NPS | | |
| $P_{13}$ | LDI | $n_1$ | |
| $P_{14}$ | ADI | 1111 | |
| $P_{15}$ | T | $P_{17}$ | |
| $P_{16}$ | T | $P_{14}$ | |
| $P_{17}$ | NPR | | |
| $P_{18}$ | WIR | | |
| $P_{19}$ | SKBI | | |
| $P_{20}$ | T | $P_7$ | |

In Table 35, $P_1$—The bit number $n_1$ of the buffer register W is loaded into ACC to reset the overall contents of the buffer register W for generating digit selection signals effective to drive a display panel on a time sharing basis.

$P_2$—After the overall contents of the register W are one bit shifted to the right, its first bit is loaded with "0". This procedure is repeated via $P_4$ until $C_4=1$ during $P_3$, thus resetting the overall contents of W.

$P_3$—The operand $I_A$ is decided as "1111" and AC+1111 is effected (this substantially corresponds to ACC−1). Since ACC is loaded with $n_1$ during $P_1$, this process is repeated $n_1$ times. When the addition of "1111" is effected following ACC=0, the fourth bit carry $C_4$ assumes "0". When this occurs, the step is advanced to $P_4$. Otherwise the step is skipped up to $P_5$.

$P_4$—When the fourth bit carry $C_4=0$ during ACC+1111, the overall contents of W are reduced to "0" to thereby complete all the pre-display processes. The first address $P_6$ is set for the memory display steps.

$P_5$—In the event that the fourth bit carry $C_4=1$ during ACC+1111, the overall contents of W have not yet reduced to "0". Under these circumstances $P_2$ is reverted to repeat the introduction of "0" into W.

$P_6$—The upper four bits of the first digit position of the memory region which contains data to be displayed are identified by the file address $m_A$ and the digit address $m_A$.

$P_7$—The contents of the specific region of the memory are unloaded into ACC. The file address of the memory still remains at $m_A$, whereas the digit address is decremented to specify the lower four bits.

$P_8$—The contents of ACC, the upper four bits, are transmitted into the temporary register X.

$P_9$—The contents of the specific region of the memory are unloaded into ACC. The file address of the memory still remains at $m_A$, whereas the digit address is decremented to specify the upper four bits of the next succeeding digit.

$P_{10}$—The contents of ACC are unloaded into the stack register SA and the contents of the temporary register X into the stack register SX.

$P_{11}$—After the contents of the register W for generating the digit selection signals are one bit shifted to the right, its first bit position is loaded with "1" and thus ready to supply the digit selection signal to the first digit position of the display.

$P_{12}$—To lead out the contents of the register W as display signals, the conditional F/F $N_p$ is supplied with "1" and placed into the set state. As a result of this, the contents of the memory processed during $P_{10}$ are displayed on the first digit position of the display.

$P_{13}$—A count initial value $n_2$ is loaded into ACC to determine a one digit long display period of time.

$P_{14}$—ACC−1 is carried out like $P_3$. When ACC assumes "0" $P_{15}$ is reached and when ACC≠0 (when $C_4=1$) the step is skipped up to $P_{16}$. This procedure is repeated.

$P_{15}$—A desired period of display is determined by counting the contents of ACC during $P_{14}$. After the completion of the counting $P_{17}$ is reached from $P_{15}$. The counting period is equal in length to a one-digit display period of time.

$P_{16}$—Before the passage of the desired period of display the step is progressed from $P_{14}$ to $P_{16}$ with skipping $P_{15}$ and jumped back to $P_{14}$. This procedure is repeated.

$P_{17}$—$N_P$ is reset to stop supplying the digit selection signals to the display. Until $N_p$ is set again during $P_{10}$, overlapping display problems are avoided by using the adjacent digit signals.

$P_{18}$—The register W is one bit shifted to the right and its first bit position is loaded with "0". "1" introduced during $P_7$ is one bit shifted down for preparation of the next succeeding digit selection.

$P_{19}$—It is decided whether the ultimate digit of the memory to be displayed has been processed and actually whether the value $n_E$ of the last second digit has been reached because the step $P_9$ of $B_L-1$ is in effect.

$P_{20}$—In the event that ultimate digit has not yet been reached, $P_7$ is reverted for the next succeeding digit display processing.

(15) PROCEDURE OF DECIDING WHICH KEY SWITCH IS ACTUATED (SENSING ACTUATION OF ANY KEY DURING DISPLAY)

Figure 36:
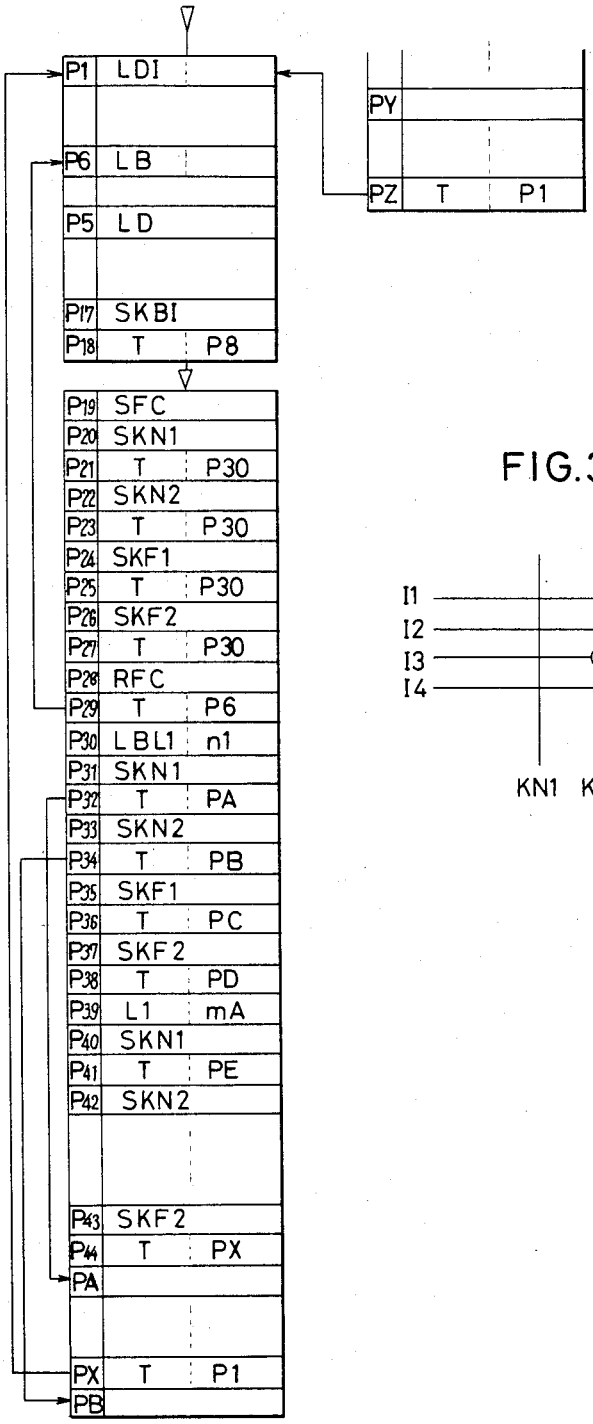
FIG. 36 is a program chart showing the procedure for key input processing.

Reference is made to FIG. 36. In FIG. 36, $P_1$–$P_{18}$—The display processes as discussed in (14) above.

Figure 37:
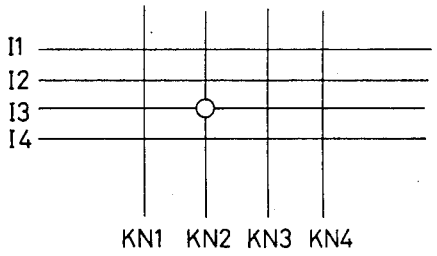
FIG. 37 is a key input circuit diagram for explanation of the procedure shown in FIG. 36.

$P_{19}$—After the overall digit contents of the register W are displayed, the flag F/F FC is set to hold all the key signals $I_l$–$I_n$ at a "1" level. (see FIG. 37)

$P_{20}$—The step is jumped to $P_{30}$ as long as any one of the keys connected to the key input $KN_1$ is actuated.

$P_{22}$–$P_{27}$—It is decided whether any one of the keys each connected to the respective key inputs $KN_2$–$KF_2$ and in the absence of any actuation the step is advanced toward the next succeeding step. To the contrary, the presence of the key actuation leads to $P_{30}$.

$P_{28}$—When any key is not actuated, F/F FC is reset to thereby complete the decision as to the key actuations.

$P_{29}$—The step is jumped up to $P_6$ to reopen the display routine.

$P_{30}$—When any key is actually actuated, the memory digit address is set at $n_1$ to generate the first key strobe signal $I_1$.

$P_{31}$—It is decided if the first key strobe signal $I_1$ is applied to the key input $KN_1$ and if not the step is advanced toward $P_{33}$.

$P_{32}$—When the first key strobe signal $I_1$ is applied to the key input $KN_1$, which kind of the keys is actuated is decided. Thereafter, the step is jumped to $P_A$ to provide proper controls according to the key decision. After the completion of the key decision the step is returned directly to $P_1$ to commence the displaying operation again ($P_Z$ is to jump the step to $P_1$).

$P_{33}$–$P_{38}$—It is sequentially decided whether the keys coupled with the first key strobe signal $I_1$ are actuated. If a specific key is actuated, the step jumps to $P_B$–$P_D$ for providing appropriate controls for that keys.

$P_{39}$—This step is executed when no key coupled with the first key strobe signal $I_1$. This step is to increment the digit address of the memory for the developments of the key strobe signals.

$P_{40}$–$P_{44}$—The appropriate key strobe signals are developed and $KN_1$–$KF_2$ are sequentially monitored to decide what kind of the keys are actuated. Desired steps are then selected to effects control steps for those actuated keys.

$P_A$—Control steps for the first actuated keys.

$P_X$—$P_1$ is returned to reopen the display operation after the control steps for the first key.

The configuration of the CPU will now be discussed in detail. FIG. 41 shows a RAM map within the CPU and FIG. 42 illustrates the relationship between the address of the word memory and its contents.

In those drawings regions $BM_0$–$BM_3$ generally designated YO, XO, WO and ZO are registers mainly for use in arithmetic operations. The WO and ZO registers are available as buffer memories for the displaying of characters as described above. The region of the ZO register covering from BL=1 to HL=8 (in other words, the fourth bit position) is used as an output buffer for the SOn output (information stored in this region of the RAM is derived directly from the SOn terminal). The VO register (BM=4, BL=0–15) serves as a temporary storage for data. The numerical information is 8-digit long, for example. Each region of the respective registers stretching from BL=4 to BL=B stores data in a mantissa, each region BL=C is an auxiliary storage section and each region as defined by BL=D–BL=F stores the weight of the data, that is, an index section. BL=F is a section for storing a minus sign of the index section. The regions as defined by BM=5 and 6 constitute various conditional flip flops and counters.

The legends and their descriptions used in the drawings are as follows:

A: the state where any functional keys such as +, −, ×and ÷ has been actuated.

B: the state where the data have been entered.

C: the state where functional operations such as are executed.

D: the state where a decimal point is specified during the key entry mode.

E: the key entry state.

F: the state where an input is applied to the word memory.

G: the initial state where an input is about to enter the word memory.

H: the state where a shift instruction is derived.

$X_D$: the location of a decimal point during the key entry mode.

$X_D'$: the preparatory process region.

$K_UK_L$: store key codes and character codes.

FU: stores functional codes (+, −, × and ÷)

U,L: word memory addition counters which store the address of the word memory.

U',L': word memory as a region for preparatory steps.

Zs,Ws,Xs,Ys: minus sign storage regions of the respective registers.

U,M,L: running display counters as timer couters which decide the period for movement of running display characters.

BM=D−F: word memory regions of a 24-character length as depicted in FIG. 42.

(OPERATION OF THE PREFERRED EMBODIMENT)

Figure 1:
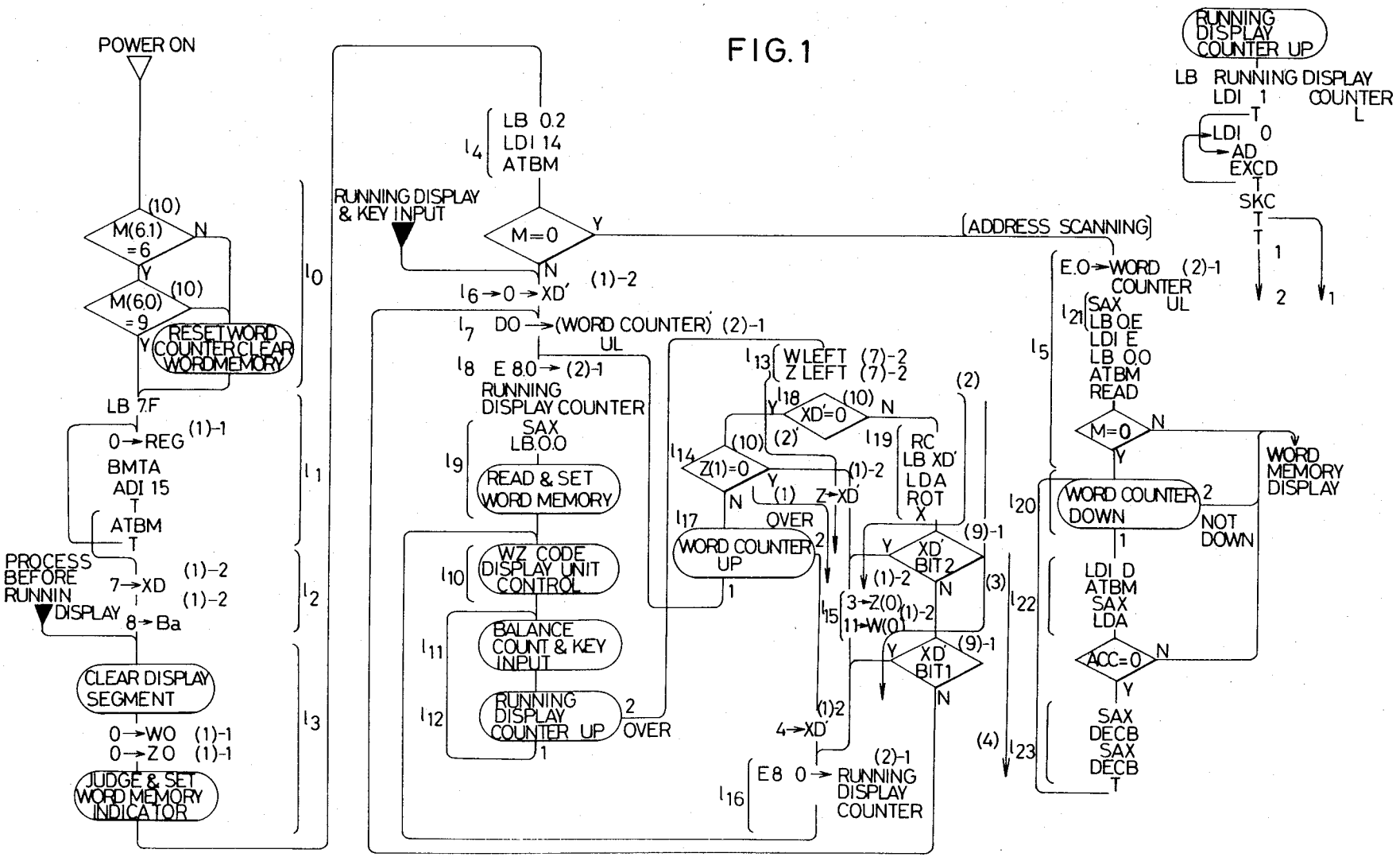
FIGS. 1 through 8 are flow charts for explanation of operation of one preferred form of the present invention.
Figure 2:
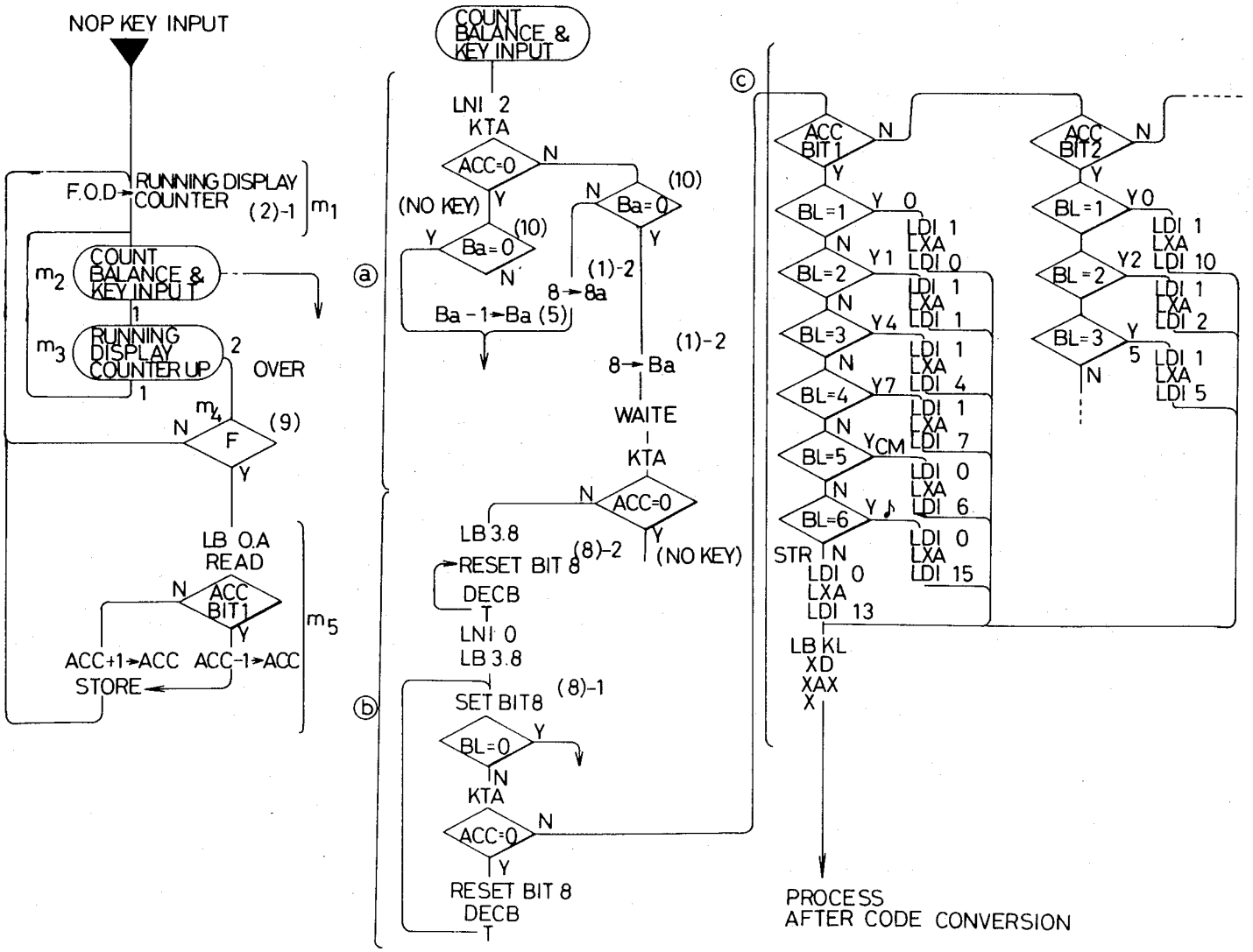
Figure 3:
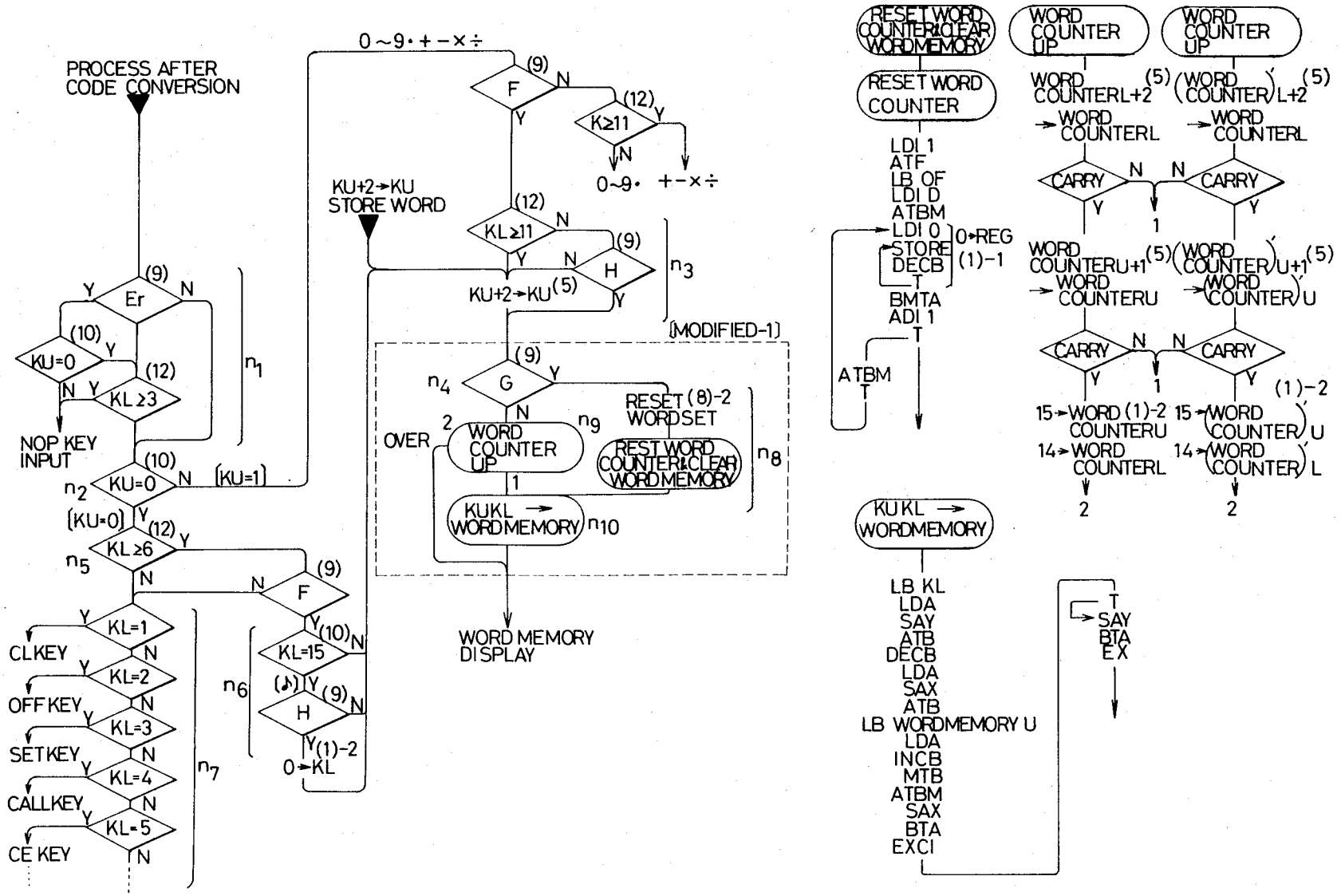
Figure 4:
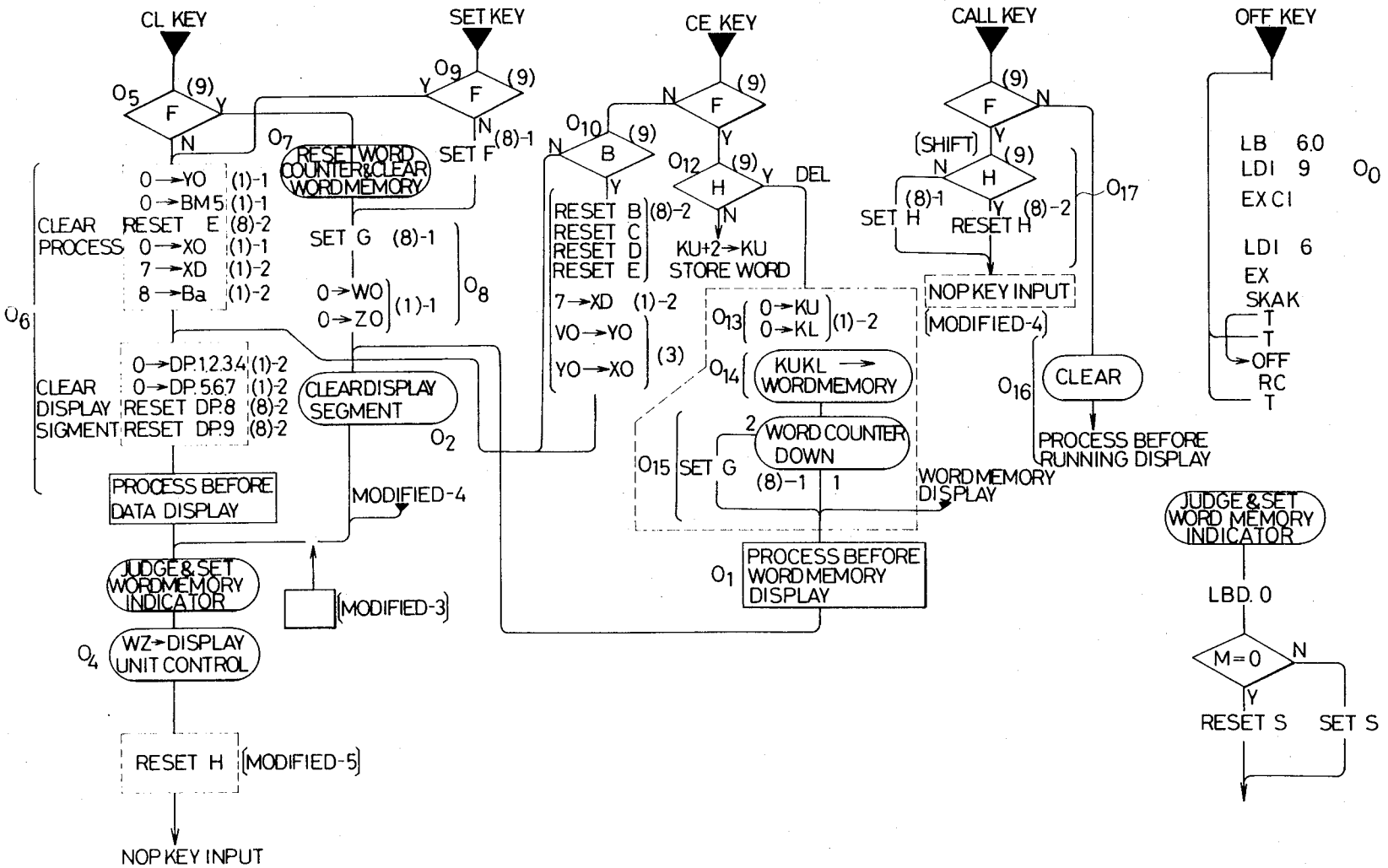
Figures 1, 5:
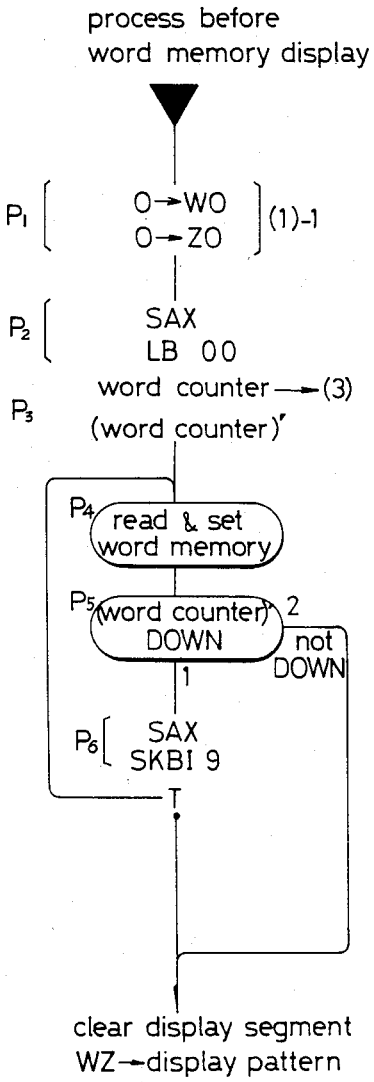
Figure 5:
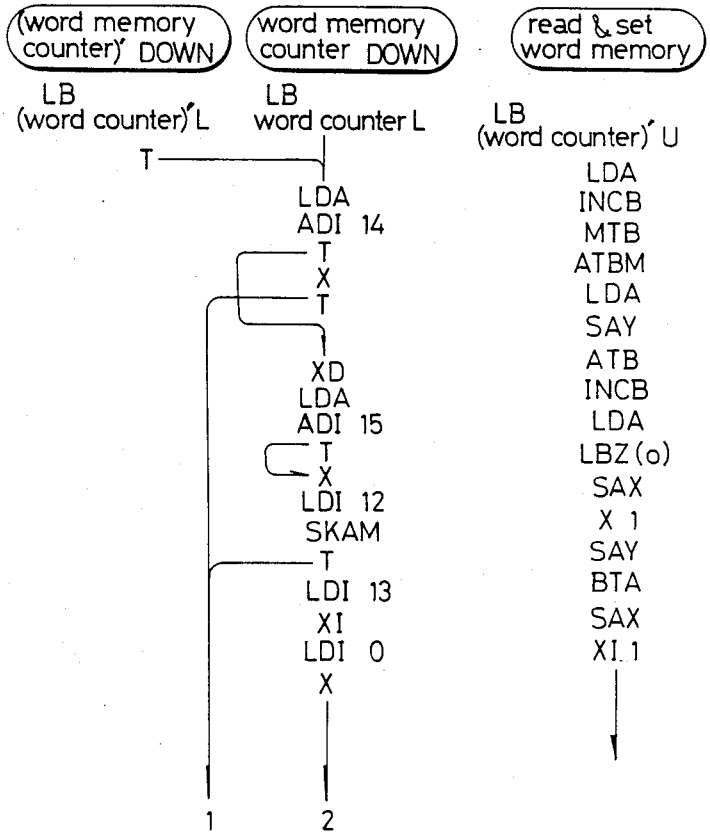
Figure 6:
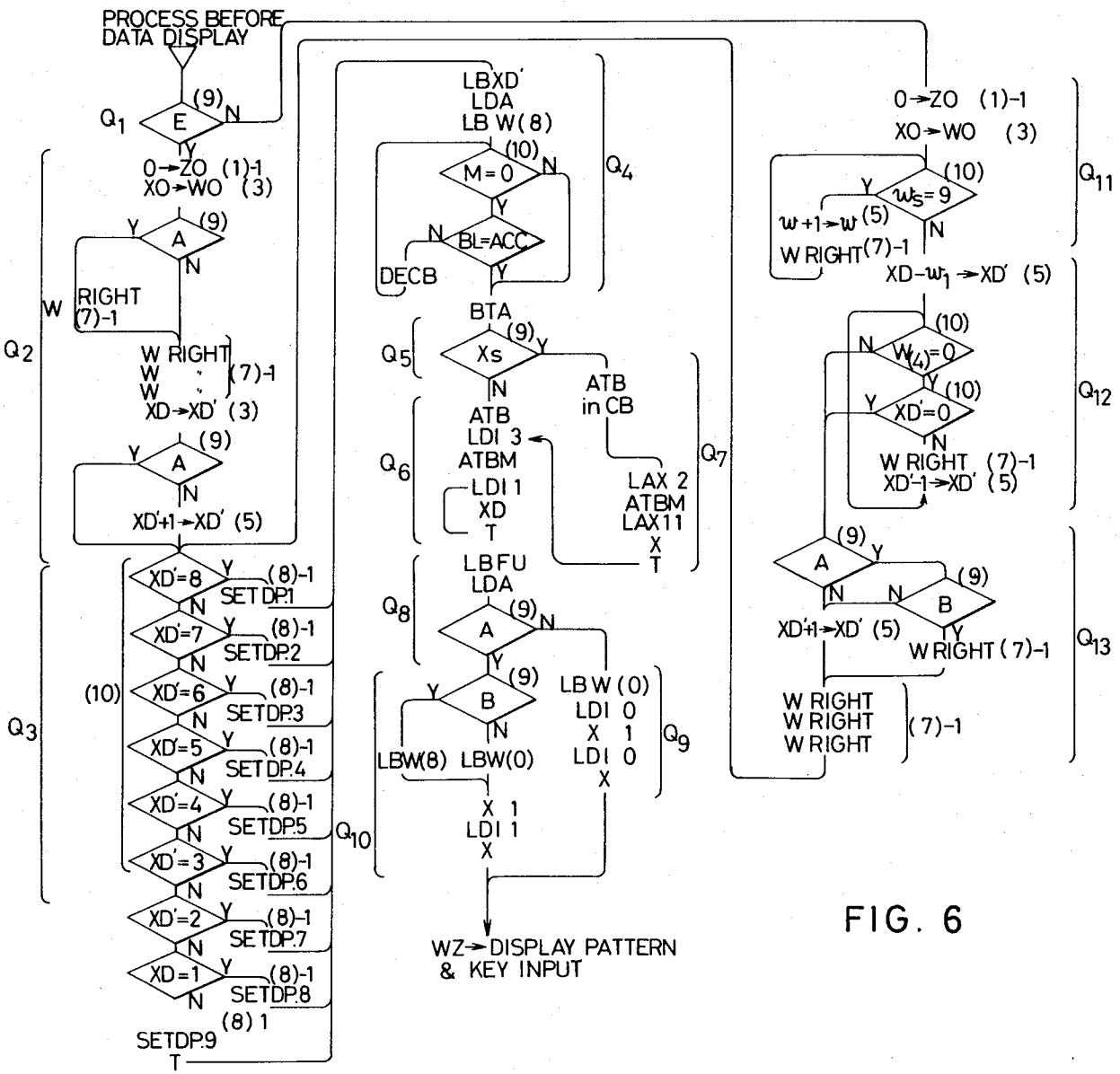
Figure 7:
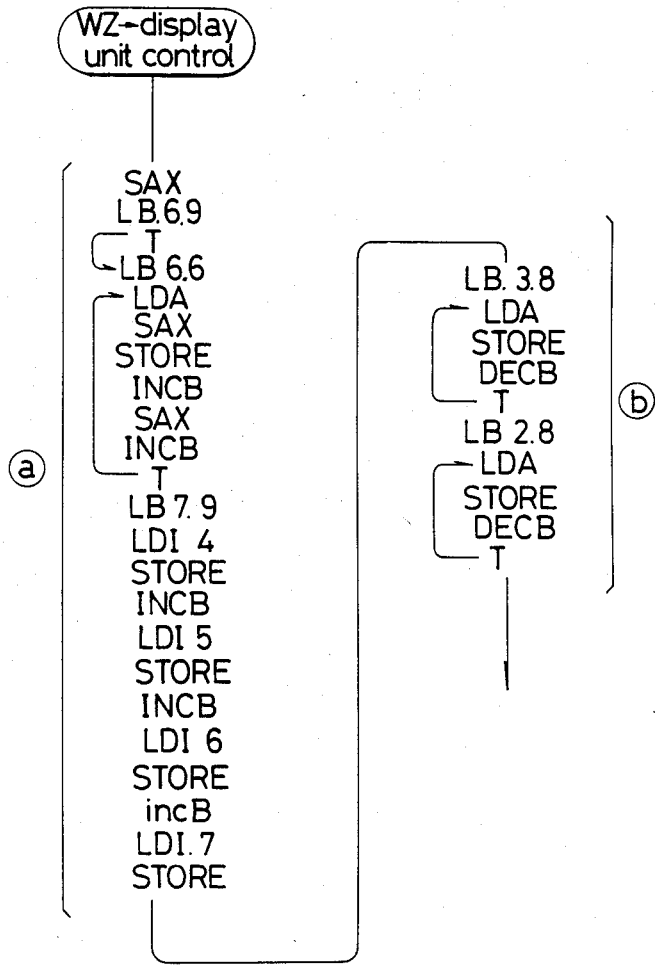
Figure 8:
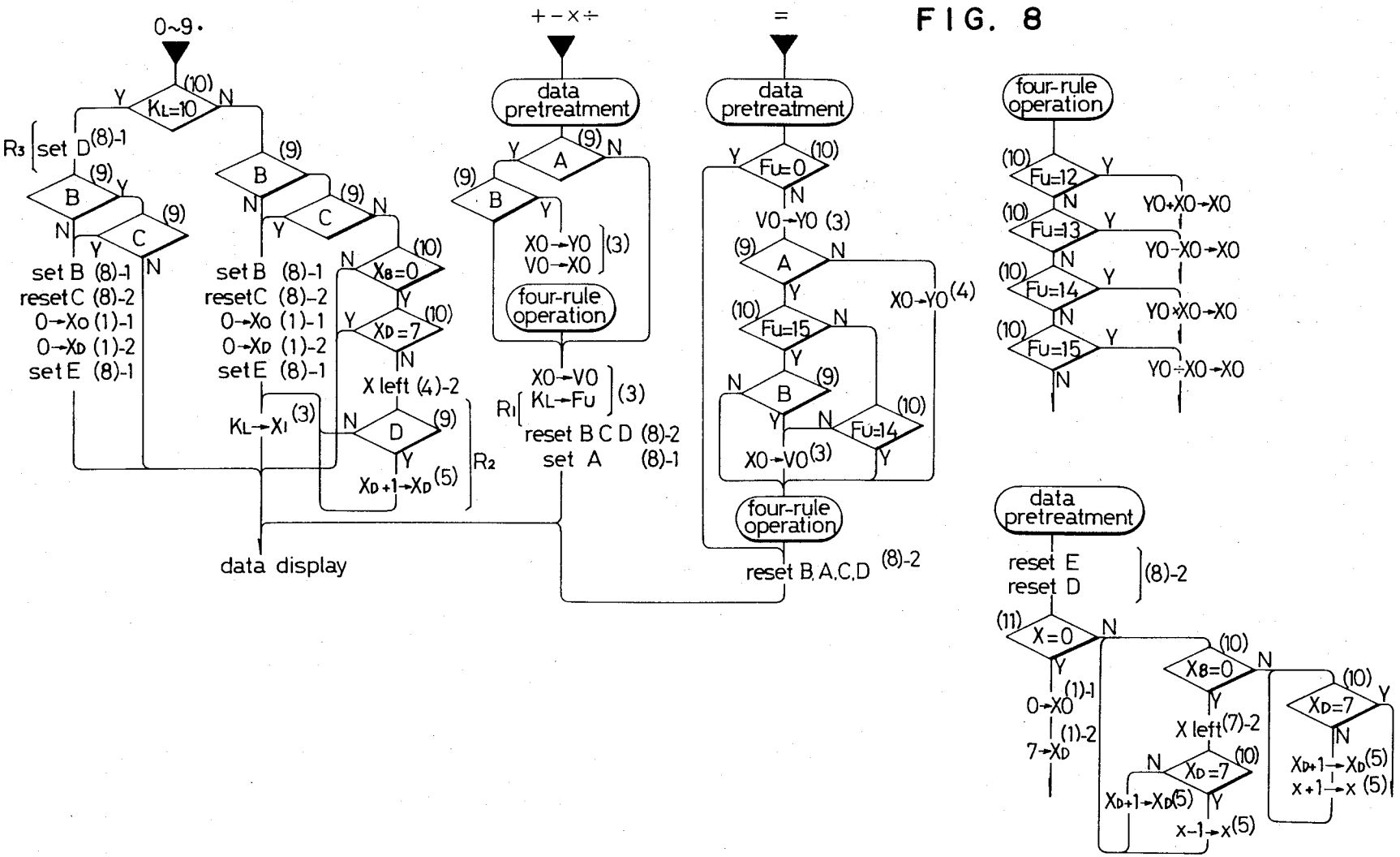

With reference to flow charts, operation of the above illustrated embodiment of the present invention will now be discussed in detail. FIGS. 1 through 8 show a full length of the procedure carried on the device. FIG. 1 depicts the procedure by which a process is initiated on the word memory for the running display mode and inputs entered via the key unit are treated upon switching ON power supply. FIG. 2 depicts the procedure by which the keyed inputs are controlled, loaded and encoded under the normal display mode (including blinking symbols). FIG. 3 depicts the procedure by which the encoded key inputs are evaluated and proper steps are selected or the character codes are loaded in sequence into the storage memory. FIG. 4 shows respective processing steps for a CL key, a SET key, a CE key, a CALL key and an OFF key. FIGS. 5 and 5-1 show readout and other pretreatments before the contents of the word memory are displayed. FIG. 6 depicts steps before the results of arithmetic operations or the keyed inputs are displayed. FIG. 7 depicts steps for operating the character generator (decoder) to convert the 6-bit character codes into the pattern information compatible with the dot pattern of the display unit and lead that information to an external displaying buffer. FIG. 8 shows steps for loading the numerical input information and executing four-rule operations (+, −, × and ÷). FIG. 43 shows the relationship between the key strobe signals and their corresponding input terminals of the microprocessor. FIG. 44 is a table showing the key codes for internal processing. FIG. 45 is a table enumerating the character codes contained within the word memory.

The whole procedure illustrated in FIGS. 1 through 8 will be described in a stepwise manner. While the whole procedure is shown as being split into several processing blocks, it is obvious that those blocks are tied together to constitute a complete and massive process. A brief prospect of the whole procedure is readily appreciated upon consideration of the foregoing description with respect to the basis subroutines (1) to (15) depicted in Tables 2 through 33 and FIG. 36. For instance, the step XO VO (3) is effected in the same manner as discussed in the basic subroutine (3). Also, FIG. 46(A) suggests the step for deciding the operating step of the conditional F/F R, wherein Y (YES) represents the set state thereof and N (NO) represents the reset state. This step is executed in a similar manner to the basic subroutine (IX). The reference number (2)-1 respective Type 1 of the basic subroutine (2). An exemplary process as defined by a lateral circle in FIG. 46(B) is a process which is used repeatedly. The reference numbers 1 and 2 in FIG. 46(B) show conditions for completing its associated step as will be discussed later. A process as defined by broken lines in FIG. 46(C) is same as that as defined by the lateral circle. The arrow as depicted in FIG. 46(D) shows the destination of the next succeeding routine. In the case of FIG. 46(D) the step NOP KEY INPUT follows. The reverse triangle shaped symbol corresponds to the arrow in FIG. 46(D) such that the routine in FIG. 46(D) floods into the flow chart beginning with the triangle symbol in FIG. 46(E). LB m,n means that BM is specified by m and BL is specified by n. For instance, LB 7,F specifies the address of the RAM where BM=7 and BL=F.

FIG. 1 depicts the routine by which the running display mode is controlled for the word memory and the keyed inputs are invited after switching ON power supply.

The process $l_0$ decides if BM, BL=(6,1), (6,0) are "6" and "9", respectively, and, if not, resets the word counter and clears the word memory. The contents of the word memory remain even when a main power supply is forced into the OFF state. However, the data within the memory might vanish in the event that power is shut off for any reason except by actuation of the OFF key or the date are not loaded in place within the memory. To detect such an erroneous condition, the main power supply is forced into the OFF state after "6" and "9" have been loaded into the regions BM, BL=(6,1), (6,0) upon actuation of the OFF key (see Oo in FIG. 4). On the other hand, when the data are properly stored within the memory, it is decided that the word memory is normal in its internal state since the data loaded under the OFF state remain unchanged upon switching ON power supply. Accordingly, when the regions BM,BL=(6,1), (6,0) do not assume "6" and "9", the contents of the word memory is not guaranteed so that the whole data within the word memory are cleared and the address counter addressing the word memory is also cleared. Details of this operation are illustrated in FIG. 3.

The step $l_1$ is a step which initializes the whole system upon switching ON power supply and specifically loads "7" and "8" into $X_D$ and Ba, respectively. It is appreciated that $X_D$ indicates the location of a decimal point and $X_D=0$ means the decimal point at the first digit place (BL=4) and $X_D=7$ that at the eighth digit place (BL=B). Since arithmetic operations are executed in exponent form except data entry, the decimal point is located at the most significant digit place of the mantissa section (i.e., $X_D=7$). Ba is a balance processing counter which decides a period of key balance and accepts "8" under the initial condition. As a matter of fact, this counter is treated during the key entry mode (see FIG. 12).

The step $l_3$ is a pretreatment for the running display mode. Since the information contained within the word memory (not including the results of arithmetic operations) is to be displayed, not only the internal memory for decimal point displaying but also that for preparation of the character codes are cleared. The step for judging and setting the word memory indicator S is executed when any input has been loaded into the word memory as best shown in FIG. 4. Especially, whether the data associated with the address (D, 0) (that is, the contents of the leading address of the word memory) are "0". Since when the data are "0" it is concluded that the word memory bears no information at the next succeeding and remaining portion thereof, the S flip flop is reset. However, if not "0", any input has been loaded at least at the leading portion of the word memory and the S flip flop has therefore been set.

In the given example, the display unit is of a 9-digit capacity and the step $l_4$ decides if the overall characters within the word memory are equal to or less than 9. When the contents of the tenth character are "0", the static (not running) display process $l_5$ begins. It is of no particular significance that BM, BL=E, 2 by virtue of $L_A \times 14$ ATBM after reducing the RAM address to BM, BL:0, 2 via the step $l_4$. It is possible that BM, BL=E, 2 directly.

Figure 13:
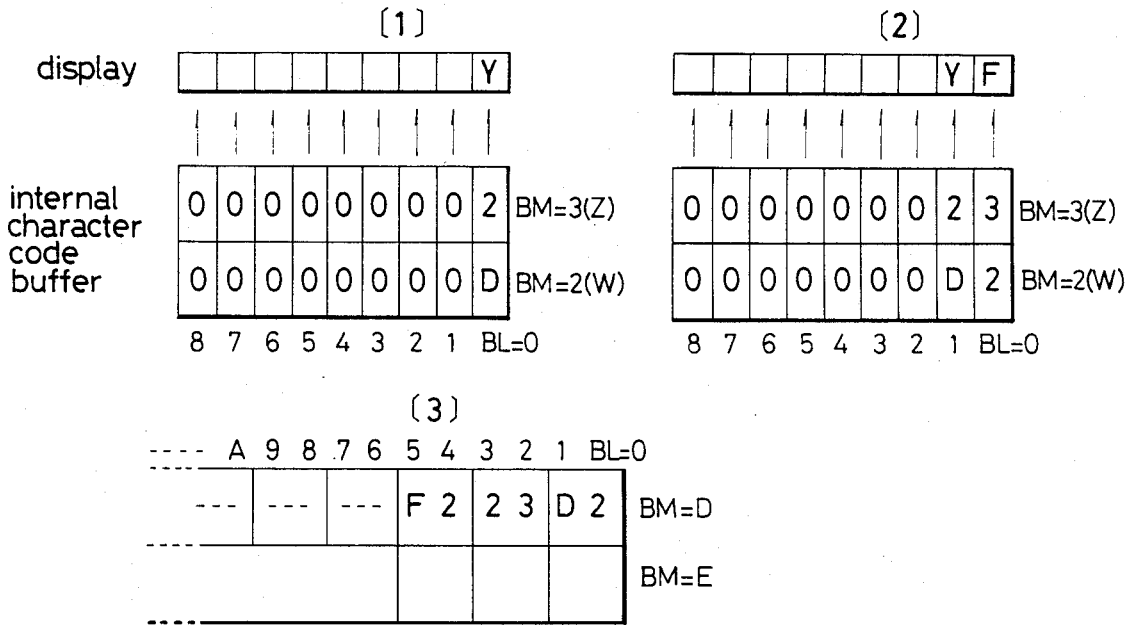

A string of the steps leading from $l_6$ is effected for performing the running display mode. $X_D'$ is a control counter for loading and displaying a character representative of (space)→(space) at the transitions of character displays and accepting "0" as its initial value. The running display mode is carried out in such a manner that the character codes stored at the word memory BM=D as shown in FIG. 13-3 are unloaded into the internal character code buffer as shown in FIG. 13-1 and outputted to the DSP unit control (WZ→DSP unit control) for displaying purposes. This situation goes on for a time. This period of time is determined by the step for processing the RUN DSP counter. After the period of time passed the next succeeding character F is shifted to the internal character code buffer as depicted in FIG. 13-2 and outputted and displayed in the same manner. Through repetition of such procedure a visual display runs sequentially to the left.

The step from FIG. 13-1 to 13-2 shifts left the W and Z memories and introduces the next succeeding character codes into the memory region where BL=0. The word memory address counter specifies the address of the character which is to be loaded into the memory region BL=0. $l_7$ initializes this procedure.

The step $l_8$ initializes each character of the counter which determines the length of the running display mode. E, 8, 0 during the step $l_8$ implies 1110−1000−0000. The step $l_9$ transfers the contents of the word memory as determined by the word memory address counter into the location BL=0 of the internal character code buffer as best shown in FIG. 5.

The step $l_{10}$ transfers the codes within the internal character code buffer into the external display unit control as best shown in FIG. 7. The step a in FIG. 7 shifts display information such as decimal points and other symbols into the region covering BL=9−c as shown in FIG. 10. The step b is under a program for unloading BM=2-3, BL=0-8 of the internal RAM into the control section. Since the address for the display unit control is composed of 5 bits, only the $F_1$ bit within BM is effective and the remaining bits are redundant. The steps $l_7$-$l_{10}$ are effected as shown in FIG. 13.

Figure 12:
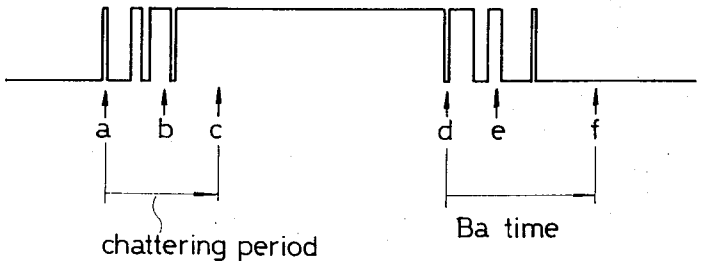

The step $l_{11}$ is a program which counts the period of time Ba of FIG. 12 and makes decision as to the keyed inputs. After the expiration of the period of time Ba, the keyed inputs establish key codes of 8 bits as shown in FIG. 4 in accordance with the respective actuated keys and thus set up the codes $K_U$, $K_L$, thereby actuating the procedure as shown in FIG. 3. Details of this procedure are illustrated in FIG. 2 wherein ⓐ is a step for deciding if the keyed inputs are present, ⓑ is a step for judging the respective keys and ⓒ is a step for conversion of the key codes.

The step $l_{12}$ is executed until an overflow comes from a counter incrementing by one each time the keyed input is sensed. The length of this step decides the period of the running display mode. The next succeeding character codes are made ready after an overflow occurs during the step $l_{12}$. The step $l_{13}$ shifts the character codes previously displayed.

The step $l_{14}$ decides if the upper 4 bits of the last prepared character codes are "0". If YES $X_D'$ is loaded with "2" and the code ← is unconditionally prepared as characters through $l_{15}$ to thereby actuate the step $l_{10}$. The step $l_{16}$ presets the counter determining the length of the running display mode. On the other hand, if NO the step $l_{17}$ increments the word memory address counter by two in order to specify the address for the chatacter which is next to be prepared. This is due to the fact that two units of BL within the word memory as shown in FIG. 13-3 constitute a word (character). When word counter specifies less than 24 characters, the subroutine (1) is selected to render the step $l_8$ operative (for preparing and displaying the next character codes). In the case where 24 characters are fully loaded and the 24th character has been derived, the step $l_{17}$ specifies the 25th character and is over to shift toward the subroutine (2). In this case the character $$\underset{1}{\text{(space)}} \xleftarrow[2]{} \underset{3}{\text{(space)}}$$

is forcedly inserted. The step $l_{13}$ develops pretendedly the (space) 1 and the steps $l_{16} \rightarrow l_{10}$ are carried out. The W and Z registers show "0000" at W(8) and Z(8), respectively, after one-digit shift through the step $l_{13}$.

Figure 14:
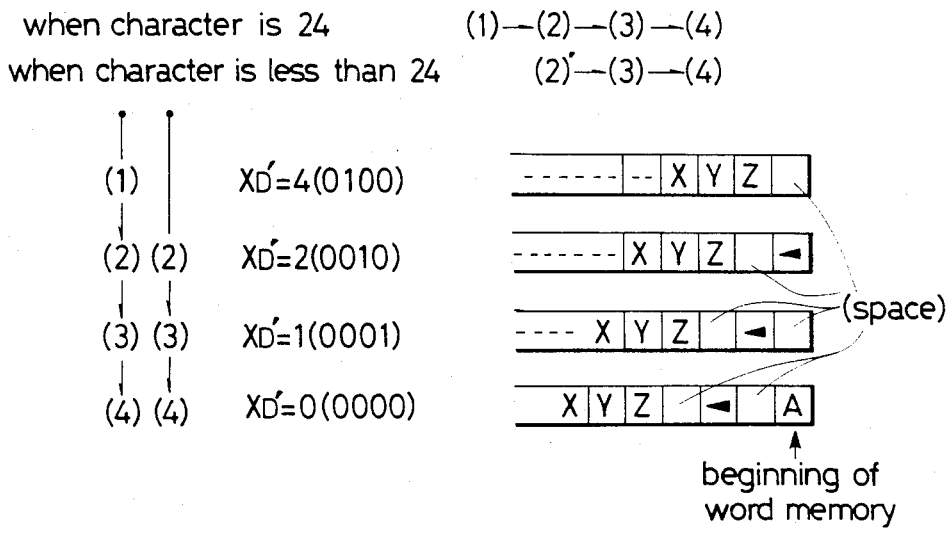

After the $X_D'$ counter is loaded with "2" or "4", the step $l_{18}$ answers NO and the step $l_{19}$ places the spaced or the character←into the internal character code buffer with the help of the $X_D'$ counter. When the second bit position of the $X_D'$ is set, the character codes←are loaded into the character buffer BL=0. When the first bit is "1", the space following←is loaded. Because the "00" codes are developed pretendedly at BL=0 due to the shift operation on the W and Z registers, the step $l_{16}$ is executed. The display mode begins again with the leading character in the word memory when $X_D'$ is "0" due to the completion of the step (space) (space). The relation between the steps $l_7$ and up for processing the $X_D'$ counter and the display mode is illustrated in FIG. 14.

In the case where the character codes contained within the word memory are less than nine, the contents of the word memory are displayed in a static mode. This routine begins with the word memory display mode in FIG. 4. The step $O_1$ (pretreatment of word memory DSP) as shown in FIG. 4 loads sequentially the internal character buffers WO and ZO, beginning with BL=0. The procedure as shown in FIG. 5 is now discussed below.

The word counter designates the memory address for the character to be first displayed. While the address is being decremented step by step, the character codes are loaded in succession into the internal character buffer in the order of increasing BL from BL=0 (see FIG. 15). The step $P_1$ clears the character code buffers WO and ZO and the step $P_3$ transfers the contents of the word counter into the second counter'. The step $P_4$ reads out the character specified by the second word counter' and sends the same into the memory BL addressed by cpu X in the internal character buffer, cpu X being an $X_B$ register storing the digit address of the RAM. The step $P_2$ sets up an initial state on cpu X with "0" which value is incremented by one every execution of the step $P_4$. Once one character has been placed into the internal buffer, the step P5 takes "2" from the word counter' which designates the address of the characters. The terminating condition 2 implies the execution of the step $P_5$ when the address specifies the first character or when the characters to be displayed are less than nine (the seventh digit in FIG. 15), thus terminating the process before display of the word memory. The terminating condition 1 is established to initiate the static display mode whereby nine digits still remaining within the word memory are displayed. The step $P_6$ decides if cpu X is equal to "9" or the internal character buffer is full of the characters. YES is answered when all the nine characters are completely processed and NO is answered when the word memory is still vacant, followed by the step $P_4$. The above procedure makes generally the character display mode ready.

Reverting the step $l_5$ and down in FIG. 1, these steps seek up to what position in the word memory the characters are stored, for the purpose of starting the static display mode. Upon the completion of these steps the word counter designates the address for the last character stored within the word memory. Because it is obvious that the characters within the word memory are less than nine at the beginning of the step $l_5$, the step $l_5$ decides if the ninth character is "0." If not "0" the address E.O represents the address for the last character within the word memory and instead the word memory display process (FIG. 5) is selected. If "0" the step $l_{20}$ decrements the word memory address counter in order to judge the contents of the eighth character.

The step $l_{22}$ is a step which fetches the contents of the word memory. Pursuant to the instruction LAX D, D is fixed (1101) and BL is specified by cpu X which is loaded with the initial value E via the step $l_{21}$. When the contents fetched are not "0", the pretreatment for the word memory display is executed. On the other hand, when they are "0", the step $l_{23}$ decrements the value of cpu X by two and sets up the address for the next character. This makes it possible to decrement the word memory counter down to the position of the character bearing character codes other than "0." After loading of the value of the word memory counter, the pretreatment for the word memory display operation is effected in order to perform the static display mode on the word memory.

After the key entry mode where keys are introduced via the KEY IN process of FIG. 2 and the key codes $K_U$ and $K_L$ are developed via the step ⓒ, the procedure of FIG. 3 is carried out by which the course of the operation is selected according to the respective actuated keys and their associated character codes are loaded into the word memory under the character input state (SET mode).

$n_1$ confines the KEY IN process to the CL and OFF keys under the error condition where Er F/F is set. The step $n_2$ is effected only when the key codes $K_U=0$ and $K_L \leqq 2$. The step $n_2$ is split depending upon whether $K_U$ is "0" or "1". In the latter case ("1"), decision is made as to the SET state and in the former case ("0") decision is made as to whether the actuated key belongs 0–9 or +, −, × and ÷.

During the SET mode the key codes are converted again via the step $n_3$ and loaded into the word memory via the steps $n_4$ and up. The character codes at this moment are illustrated in FIG. 45. When $K_U=0$ the keys $K_L \geqq 6$ specify the character codes under the SET mode, those characters being converted via the steps $n_6$ and $n_3$ and loaded into the word memory via the steps $n_4$ and up. Judgement of $K_L$ splits the key-related processes $n_7$ when the set state is not present.

G F/F implies the first state where the character codes are loaded into the word memory. The SET key when actuated recovers the set state (FIG. 4). When YES is provided during the step $n_4$, the first character is specified. The word counter is reset (the leading address of the word memory is specified) during $n_8$ and the word memory is completely cleared and G F/F is reset to thereby unlock the initial state. During $m_0$ the character codes $K_U$ and $K_L$ are stored within the word memory designating the address. At this moment the word counter designates the address of the word memory where the characters are now loaded. Since G F/F is reset when the next character is loaded into the word memory, the steps $n_4$ $n_9$ are effected with the latter ($n_9$) incrementing the word counter by two (one-character) and designating the address of the word memory which an input is about to be introudced. The terminating condition 2 is evaluated to skip the input step $n_{10}$ when the 24th character is specified. Otherwise, the character codes are loaded into the word memory during the step $n_{10}$. Thereafter, the contents of the word memory are displayed via the procedure as depicted in FIG. 4.

$O_1$ represents the procedure as shown in FIG. 5 by which the character codes of the characters to be displayed are loaded into the internal character buffer. The next succeeding step $O_2$ the internal F/Fs for energizing decimal points are all reset. The step $O_3$ decides if the character has been inputted into the word memory and sets the energizing F/F (S). The step $O_4$ transfers the information in the internal character buffers W and Z into the display control.

Details of the key input process which follows are depicted in FIG. 2. While the key input process is executed during the running display subroutine of FIG. 1, the key input process in FIG. 2 enables the indicator showing the SET mode to blink. The step $m_1$ sets up an initial condition for the counter which determines the length of blinking of the indicator. The counter may be realized by the above mentiond memory for the running display.

The step $m_2$ is a read-in step with the balance time. As discussed above, the key input split process of FIG. 3 is executed in the presence of the keyed inputs. Unless the requirement for the keyed inputs is fulfilled, the step $m_3$ is executed to increment the running display counter which has already been placed into the initial state. If no overflow occurs, the terminating condition 1 is reached to recover the key input process $m_2$.

The steps $m_2$ and $m_3$ are repeatedly carried out. If an overflow occurs from the running display counter, the terminating condition 2 is satisfied during the step $m_3$ to thereby start the step $m_4$. The period of time until the overflow occurs during the step $m_3$ during repeated execution of the steps $m_2$ and $m_3$ determines the length of blinking of the word memory indicator.

The step $m_4$ decides if the word memory is available in loading the characters. F F/F is a F/F indicating the SET mode. The step $m_5$ blinks the indicator in the set mode. The power one bit of the contents of the OA (8-bit address) within the display unit control, that is, S bit is fetched under the set mode. When S is "1", subtraction of "1" is effected and when S is "0" addition of "1" is effected, thus inverting the S bit each execution of the step $m_5$. In other words, the display segment corresponding to S blinks when the character codes within the control are decoded and outputted.

When the respective keys CL, SET, CE, CALL and OFF are actuated during the running display mode or the normal key input mode, their associated processing routines are selected via the step $n_7$ of FIG. 3. The respective processing routines are shown in FIG. 4.

(CL KEY)

The step $O_5$ determines the operating conditions of F F/F representing whether the characters are in the set state. If NO, actuation of the CL key unlocks and clears the calculation state of the running display state. The CL step during the course $O_6$ clears the input and calculation registers and sets up initial states for the various F/Fs. The step (display segment CL) clears all the bits of the RAM indicating energization of decimal points. The decimal points are located properly through the pretreatment for the data DSP, as will be more clear from FIG. 6. The contents of the XO register are converted into a form compatible with the display unit and in other words the character codes. After that, the steps $O_3$ and up cause display outputs and effect the key input process again. Actuation of the CL key clears all of the word memory and the display unit during the set mode (character input state). The step $O_7$ clears the word memory and initializes the word memory address counter. The step $O_8$ sets G F/F to clear the displaying character buffers WO and ZO, followed by the step $O_2$. G F/F implies the initial input state of the character memory and prevents the address counter from being incremented only when the leading character is inputted by virtue of the step $n_4$ in FIG. 3.

(SET KEY)

The SET key establishes or unlocks the set mode when the whole system is not in the set mode or actually in the set mode, respectively. The step $O_9$ is effected to decide if F F/F is in the set state and then the CL process following $O_6$ is carried out. With the state $\bar{F}$ present, F F/F representing the set mode is set. The steps $O_8$ and up are carried out to clear the display unit.

(CE KEY)

The CE (clear entry) key clears the keyed inputs when not in the set mode. It also specifies the character X when no shift key is actuated under the set mode and serves as the DEL key when the shift key is actuated (see FIG. 19).

The step $O_{10}$ is effected when not in the set mode. Nothing occurs when B F/F is not set. When B F/F is set, the step $O_{11}$ resets the F/F representing the key entry mode and transfers the previous data into VO which in turn feeds the received data into the XO register. Then, the data display process (display segment CL) $O_6$ is effected to unlock the entry state and regain the previous state.

When in the set mode the step $O_{12}$ decides if the shift key is actuated and if NO the character X key renders the step $n_3$ of FIG. 3, $K_U+2$ $K_U$ operative to enter the character codes. When the shift key is actuated this key behaves as the DEL (delete) key to delete the last input character or the character on the extreme right of the display unit. The step $O_{13}$ zeros all the character codes $K_U$, $K_L$. The step $O_{14}$ locates those codes into the word memory showing the word memory address counter. In addition, the step $O_{15}$ decrements the word counter. The terminating condition 2 is satisfied when the thus deleted character is the leading character (or loaded into the leading address of the word memory). At this time the word memory is fully vacant so that G F/F indicating the initial input state of the word memory is set. Thereafter, the pretreatment before the word memory display operation is carried out.

(CALL KEY)

When not in the set mode, this key instructs the running display mode for the characters contained within the word memory. In addition, this key serves as the shift key under the set state. The shift key is set or reset repeatedly each time the key is actuated. When not in the set mode the step $O_{16}$ clears the calculation state and starts the running display mode after the step $l_3$ in FIG. 1. The step $O_{17}$ inverts H F/F showing the shift state.

(OFF KEY)

The OFF key places the above illustrated calculator into the OFF state. The regions of an address (6,0), (6,1) are located with "9" and "6." These values are to make sure that the contents of the memory are quaranteed even upon switching ON power supply. Such confirmation is provided by the step $l_0$ of FIG. 1. This OFF process is implemented with a hardware of a microprocessor responsive to the OFF instruction.

(DATA DSP PRETREATMENT)

Figures 1, 16:
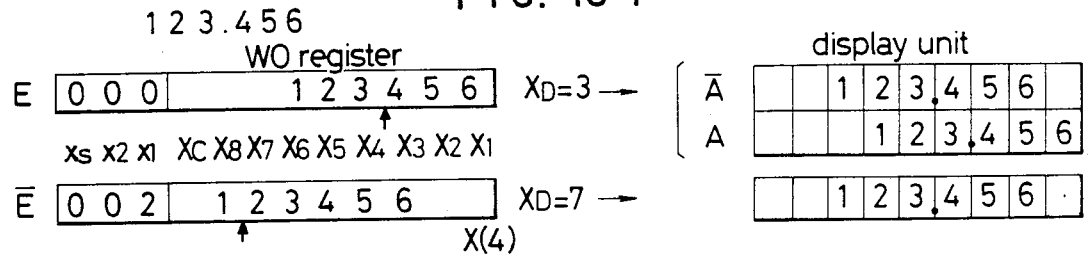
Figures 2, 16:
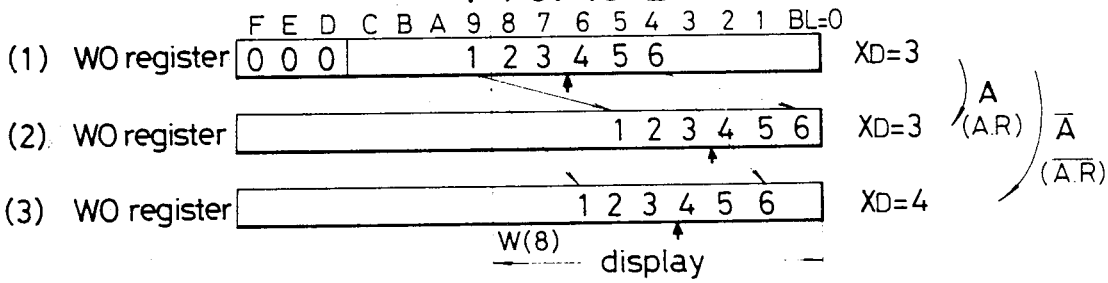
Figures 3, 16:
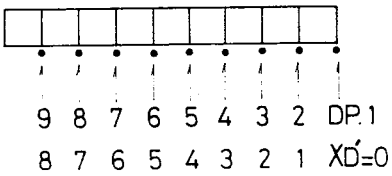
Figures 4, 16:
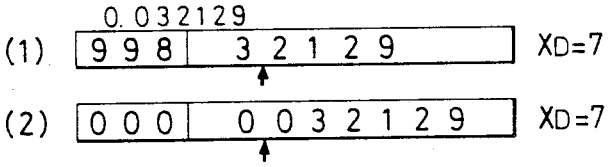

The data within the XO register are converted into a form compatible with the display unit and thus into 8-bit character codes and thereafter loaded into the internal character buffers WO and ZO. In the case where a numeric 123.456 is in the XO register as shown in FIG. 16, the contents of the XO and $X_D$ registers are different between when in the entry mode (E) and when not in the entry mode ($\overline{E}$). Under these circumstances a display pattern as shown in the right side of FIG. 16 is developed. Basically, the contents of the XO register are unloaded into the WO register and shift operation is effected due to the value $X_D$ to locate the lower 4 bits of the character codes. Since the upper four bits of the character codes are all 1(0001), all that is necessary is to load "1" (see FIG. 45).

When E is set (the entry mode) by $Q_1$, the step $Q_2$ transfers the contents of the XO register into the WO register as shown in FIG. 16-2. Under the circumstance the display at the first digit position of the display unit differs between the state A (with the four-rule keys actuated) and the state $\overline{A}$ (before the four-rule keys are actuated). $X_D'$ is present instead of $X_D$. In other words, the XO register and $X_D$ are held unchanged.

The step $Q_3$ sets the decimal point bit and energizes its associated segment. The relationship between $X_D'$ and the location of decimal points is shown in FIG. 16-3. This routine terminates establishment of the lower 4 bits of the numerical information. The step $Q_4$ locates the upper 4 bits of the character codes into the ZO register (including so-called zero suppressing) and decides if the contents of the WO register assure "0" at the position W(8) or seeks the extreme left position where the address (BL) is equal to $X_D'$.

The step $Q_5$ decides if the numerical information is minus and if not the step $Q_6$ inserts "1" into the region covering from BL detected by the step $Q_4$ to BL=0. If minus the step $Q_7$ locates the lower 4-bit value B at BL+1 of the WO register with a minus sign (−) and "1" into the region covering from the corresponding position of the ZO register to BL=0.

The step $Q_8$ and up are steps for displaying symbols for the actuated four-rule keys together with a visual display of the numerical information. The codes indicative of the four-rule keys (+, −, ×, ÷) are loaded into the memory area Fu in the form of 4 bit codes by way of the step $R_1$ of FIG. 8. The step $Q_8$ recalls the codes relating to the four-rule keys and decides if A F/F indicating the actuated four-rule keys is in the set state. With the state $\overline{A}$, the contents of the WO and ZO registers are cleared at the position BL=0, thus completing this sequence of operation ($Q_9$). Under the state A, B F/F and whether the data are inputted are decided. If YES the codes indicative of the four-rule keys are loaded into the WO and ZO registers at the extreme left side BL=8 or the extreme right side BL=0, respectively, when B or $\overline{B}$ is sensed. (see FIG. 22).

The step $Q_1$ is coupled to the steps $Q_{11}$ and $Q_{12}$ when not in the key entry mode ($\overline{E}$). As shown in FIG. 16-1, the steps $Q_{11}$ and $Q_{12}$ convert the data format in the case $\overline{E}$ into that in the case E.

The step $Q_{11}$ converts the numerical information XO 1 (see FIG. 16-4) form the form (1) to the form (2) and adds "1" to the index portion w while shifting the mantissa portion, until the w register bears "0".

The next succeeding steps $X_D - w_1 \rightarrow X_D'$ determine where the decimal point is located in the mantissa portion in view of the weight of the w register, with the result being transferred to $X_D'$. The step $Q_{12}$ shifts right the data converted during the step $Q_{11}$. The W register is shifted right only when WO(4) is "0" and $X_D' \neq 0$ (in other words, the decimal point is not located at the extreme right side). The step $X_D'$ 1 $X_d'$ is effected. The result is that the form $\overline{E}$ of FIG. 16-1 is converted into the form E. The step $Q_{13}$ is similar to the step $Q_2$ and converts the form (2) of FIG. 16-2 into the forms (2) and (3). Thereafter, the same procedure is carried out as do the steps $Q_3$ and up.

Figure 38:
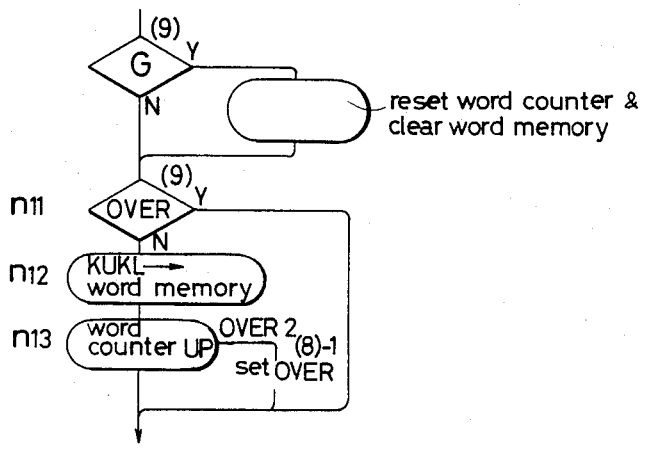
FIG. 38 is a flow chart showing a further modification in a modified-1 section of FIG. 3.
Figure 39:
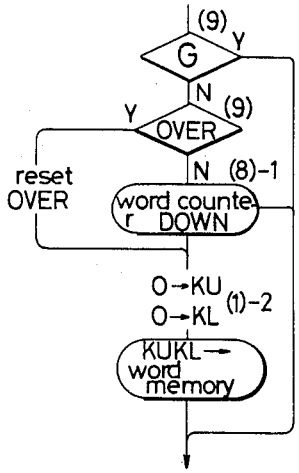
FIG. 39 is a flow chart showing a further modification in a modified-2 section of FIG. 4.
Figure 40:
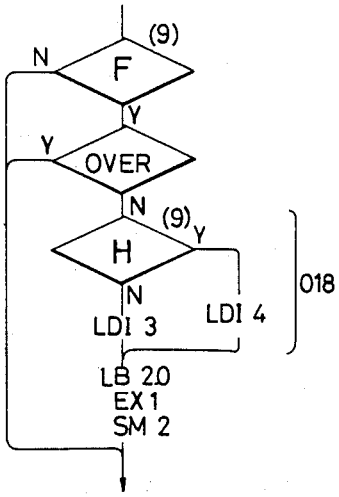
FIG. 40 is a flow chart showing a further modification in a modified-3 section of FIG. 4.

The following sets forth some modified embodiments of the present invention. The modified form 1 of FIG. 3 replaces the corresponding part of FIG. 38. The modified form 2 of FIG. 4 replaces that of FIG. 39 and the modified form 3 of FIG. 4 replaces that of FIG. 40. The modified form 4 in FIG. 4 shows a modified NOP KEY INPUT process. It is also possible that the modified form 5 of FIG. 4 (RESET H) may be eliminated. Those modified embodiments of the present invention are are different from the above illustrated embodiment in the following aspects.

(1) A cursor is displayed on the extreme right side of the display during the period of time where the characters are loaded into the word memory, indicating the location of the character to be next introduced. When the word memory is full, no cursor is displayed.

Figure 17:
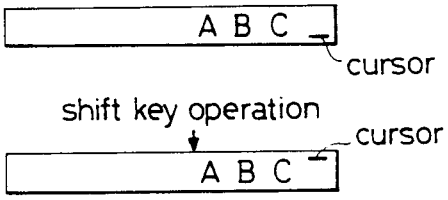
Figure 24:
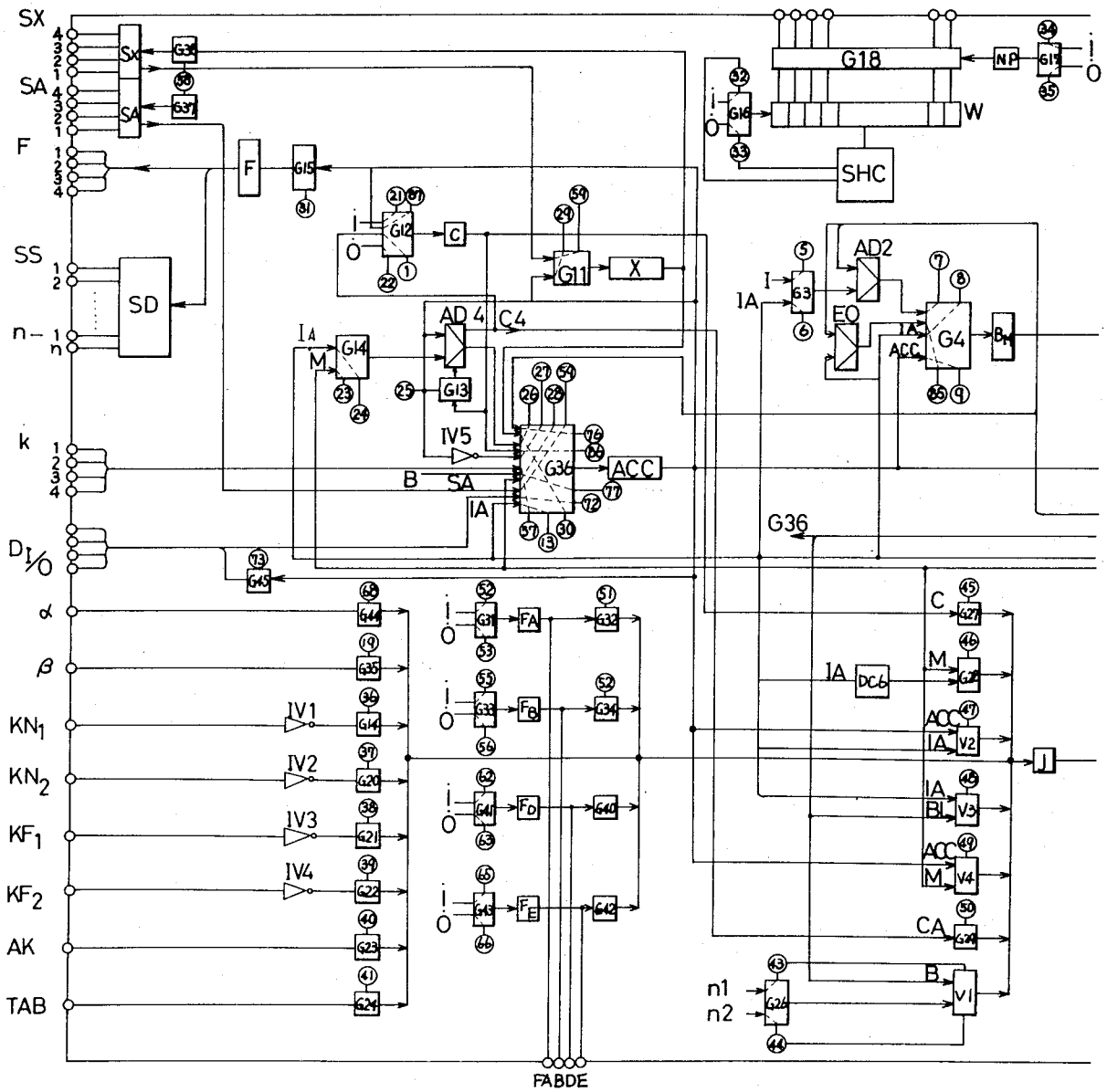
FIG. 24 is a perspective view of the appearance of the above illustrated embodiment.

(2) Once depressed the shift key holds the shift state until the key is actuated again. At this moment the cursor is displayed on the digit position (see FIG. 17).

Whereas the present invention has been described with respect to specific embodiments thereof, it will be understood that various changes and modifications will be suggested to one skilled in the art, and it is intended to encompass such changes and modifications as fall within the scope of the appended claims.

We claim:

1. An electronic device capable of displaying characters or symbols on a display in a running display mode or in a static display mode, said display having a predetermined display capacity, said device comprising:

memory means for storing a certain number of said characters or symbols;

comparator means responsive to the number of said characters or symbols stored in the memory means for determining if the number of said characters or symbols exceeds said predetermined display capacity; and control means responsive to said comparator means for initiating said running display mode by sequentially shifting said characters or symbols across said display when the number of said characters or symbols stored in said memory means exceeds said display capacity, and initiating said static display mode by producing a stationary display of said characters or symbols on said display when the number of said characters or symbols stored in said memory means does not exceed said display capacity.

2. An electronic device in accordance with claim 1, wherein the control means initiates said static display mode on said display when said electronic device functions as a calculator even if said comparator means determines that said characters or symbols stored in said memory means exceeds said predetermined display capacity.

3. An electronic device in accordance with claim 2, wherein said display includes a numerical display section, and wherein a first operand, a second operand, and arithmetic symbols appear in said numerical display section of said display when said electronic device functions as said calculator.

4. An electronic device in accordance with claim 1, wherein the storing means inserts an identifying symbol between the beginning and the end of said characters or symbols stored therein thereby enabling a repeated display of said characters or symbols on said display.

5. An electronic device in accordance with claim 1, further comprising:

key input means for introducting said characters or symbols into said memory means.

6. An electronic device in accordance with claim 3, wherein said arithmetic symbols are displayed on the right side of said first operand within said numerical display section of said display.

7. An electronic device in accordance with claim 3, wherein said arithmetic symbols are displayed on the left side of said second operand within said numerical display section of said display.

* * * * *